US008845296B2

(12) United States Patent
Collier et al.

(10) Patent No.: US 8,845,296 B2
(45) Date of Patent: Sep. 30, 2014

(54) AIRFOIL SHAPE FOR TURBINE BUCKET AND TURBINE INCORPORATING SAME

(75) Inventors: Matthew Durham Collier, Simpsonville, SC (US); Gayathri Puram, Karnataka (IN); Paul Kendall Smith, Simpsonville, SC (US); Jacob Charles Perry, II, Taylors, SC (US)

(73) Assignee: General Electric Company, Schenectady, NY (US)

( * ) Notice: Subject to any disclaimer, the term of this patent is extended or adjusted under 35 U.S.C. 154(b) by 552 days.

(21) Appl. No.: 13/235,765

(22) Filed: Sep. 19, 2011

(65) Prior Publication Data

US 2013/0071249 A1 Mar. 21, 2013

(51) Int. Cl.
*F01D 5/14* (2006.01)

(52) U.S. Cl.
CPC ..... *F01D 5/141* (2013.01); *F05D 2250/74* (2013.01); *Y10S 416/02* (2013.01)
USPC ..... 416/243; 416/223 A; 416/DIG. 2

(58) Field of Classification Search
CPC ..... F01D 5/14; F01D 5/141; F04D 29/242; F05D 2250/74
USPC ..... 415/191; 416/223 A, 223 B, 223 R, 243, 416/DIG. 2
See application file for complete search history.

(56) References Cited

U.S. PATENT DOCUMENTS

| | | | |
|---|---|---|---|
| 4,900,230 | A | 2/1990 | Patel |
| 5,160,242 | A | 11/1992 | Brown |
| 5,267,834 | A | 12/1993 | Dinh et al. |
| 5,277,549 | A | 1/1994 | Chen et al. |
| 5,286,169 | A | 2/1994 | Dinh et al. |
| 5,299,915 | A | 4/1994 | Dinh et al. |
| 5,393,200 | A | 2/1995 | Dinh et al. |
| 5,445,498 | A | 8/1995 | Williams et al. |
| 5,480,285 | A | 1/1996 | Patel et al. |
| 5,509,784 | A | 4/1996 | Caruso et al. |
| 6,450,770 | B1 | 9/2002 | Wang et al. |
| 6,461,110 | B1 | 10/2002 | By et al. |
| 6,474,948 | B1 | 11/2002 | Pirolla et al. |
| 6,503,059 | B1 | 1/2003 | Frost et al. |
| 6,558,122 | B1 | 5/2003 | Xu et al. |
| 6,575,700 | B2 | 6/2003 | Arai et al. |
| 6,579,066 | B1 | 6/2003 | Saito et al. |
| 6,739,839 | B1 | 5/2004 | Brown et al. |
| 6,846,160 | B2 | 1/2005 | Saito et al. |
| 6,881,038 | B1 | 4/2005 | Beddard et al. |
| 6,910,868 | B2 | 6/2005 | Hyde et al. |
| 7,094,034 | B2 | 8/2006 | Fukuda et al. |
| 7,186,090 | B2 | 3/2007 | Tomberg et al. |
| 7,384,243 | B2 | 6/2008 | Noshi |
| 2008/0101959 | A1 | 5/2008 | McRae et al. |

*Primary Examiner* — Edward Look
*Assistant Examiner* — Jason Davis
(74) *Attorney, Agent, or Firm* — James W. Pemrick; Ernest G. Cusick; Frank A. Landgraff

(57) ABSTRACT

A turbine bucket is provided including a bucket airfoil having an airfoil shape, the bucket airfoil having a nominal profile substantially in accordance with Cartesian coordinate values of X, Y and Z set forth in Table 1 wherein the Z values are non-dimensional values from 0% to 100% convertible to Z distances in inches by multiplying the Z values by a height of the airfoil in inches and adding the radius of the airfoil base, and wherein X and Y are distances in inches which, when connected by smooth continuing arcs, define airfoil profile sections at each distance Z, the profile sections at the Z distances being joined smoothly with one another to form a complete airfoil shape.

18 Claims, 2 Drawing Sheets

AIRFOIL SHAPE FOR TURBINE BUCKET AND TURBINE INCORPORATING SAME

BACKGROUND OF THE INVENTION

The present invention relates to an airfoil for a bucket of a stage of a gas turbine and particularly relates to a shape defining a turbine bucket airfoil profile.

In a gas turbine, many system requirements should be met at each stage of a gas turbine's flow path section to meet design goals. These design goals include, but are not limited to, overall improved efficiency and airfoil loading capability. For example, and in no way limiting of the invention, a blade of a compressor should achieve thermal and mechanical operating requirements for that particular stage. Further, for example, and in no way limiting of the invention, a blade or bucket of a turbine should achieve thermal and mechanical operating requirements for that particular stage.

BRIEF DESCRIPTION OF THE INVENTION

An aspect of the present invention may be embodied by a turbine bucket including a bucket airfoil having an airfoil shape, the bucket airfoil having a nominal profile substantially in accordance with Cartesian coordinate values of X, Y and Z set forth in Table 1 wherein the Z values are non-dimensional values from 0% to 100% convertible to Z distances in inches by multiplying the Z values by a height of the airfoil in inches and adding the radius of the airfoil base, and wherein X and Y are distances in inches which, when connected by smooth continuing arcs, define airfoil profile sections at each distance Z, the profile sections at the Z distances being joined smoothly with one another to form a complete airfoil shape.

An aspect of the present invention may be embodied in a turbine bucket including a bucket airfoil having a suction-side uncoated nominal airfoil profile substantially in accordance with suction-side Cartesian coordinate values of X, Y and Z set forth in Table 1 wherein the Z values are non-dimensional values from 0% to 100% convertible to Z distances in inches by multiplying the Z values by a height of the airfoil in inches and adding the radius of the airfoil base, and wherein X and Y are distances in inches which, when connected by smooth continuing arcs, define airfoil profile sections at each Z distance, the profile sections at the Z distances being joined smoothly with one another to form a complete suction-side airfoil shape, the X, Y and Z distances being scalable as a function of the same constant or number to provide a scaled-up or scaled-down airfoil.

An aspect of the present invention may be embodied in a turbine comprising a turbine wheel having a plurality of buckets, each of the buckets including an airfoil having an airfoil shape, the airfoil having a nominal profile substantially in accordance with Cartesian coordinate values of X, Y and Z set forth in Table 1 wherein the Z values are non-dimensional values from 0% to 100% convertible to Z distances in inches by multiplying the Z values by a height of the airfoil in inches and adding the radius of the airfoil base, and wherein X and Y are distances in inches which, when connected by smooth continuing arcs, define the airfoil profile sections at each distance Z, the profile sections at the Z distances being joined smoothly with one another to form a complete airfoil shape.

An aspect of the present invention may be embodied in a turbine comprising a turbine wheel having a plurality of buckets, each of the buckets including an airfoil having a suction-side airfoil shape, the airfoil having a nominal profile substantially in accordance with suction-side Cartesian coordinate values of X, Y and Z set forth in Table 1 wherein the Z values are non-dimensional values from 0% to 100% convertible to Z distances in inches by multiplying the Z values by a height of the airfoil in inches and adding the radius of the airfoil base, and wherein X and Y are distances in inches which, when connected by smooth continuing arcs, define the airfoil profile sections at each distance Z, the profile sections at the Z distances being joined smoothly with one another to form a complete suction-side airfoil shape.

BRIEF DESCRIPTION OF THE DRAWINGS

These and other objects and advantages of this invention, will be more completely understood and appreciated by careful study of the following more detailed description of the presently preferred example embodiments of the invention taken in conjunction with the accompanying drawings, in which.

DETAILED DESCRIPTION OF THE INVENTION

Figure 1:
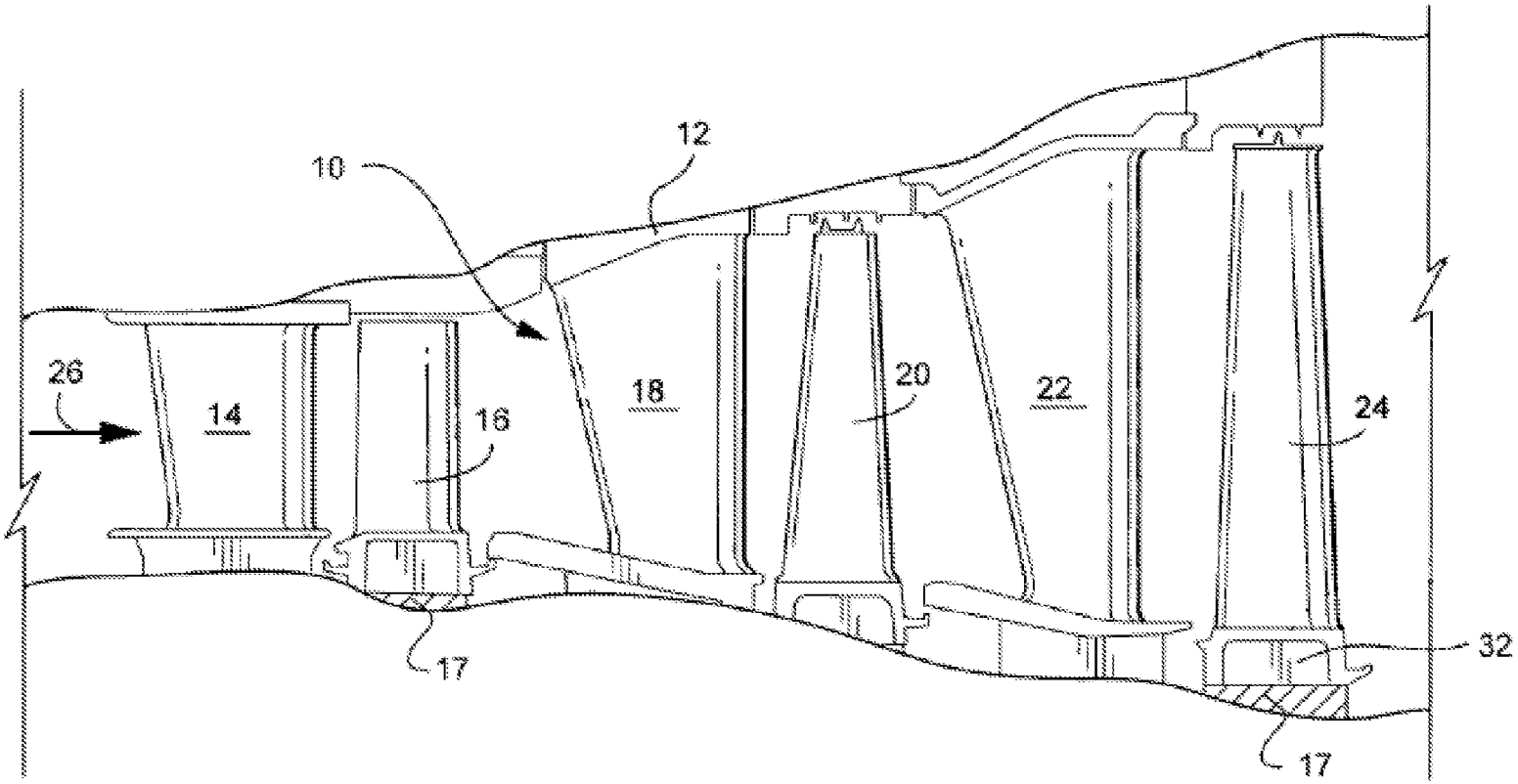
FIG. 1 is a schematic representation of a hot gas path through multiple stages of a gas turbine and illustrates a bucket airfoil according to an example embodiment of the present invention.

Referring now to the drawings, particularly to FIG. 1, there is illustrated a hot gas path, generally designated 10, of a gas turbine 12 including a plurality of turbine stages. Three stages are illustrated. For example, the first stage comprises a plurality of circumferentially spaced nozzles 14 and buckets 16. The nozzles are circumferentially spaced one from the other and fixed about the axis of the rotor. The first stage buckets 16, of course, are mounted on the turbine rotor 17. A second stage of the turbine 12 is also illustrated, including a plurality of circumferentially spaced nozzles 18 and a plurality of circumferentially spaced buckets 20 mounted on the rotor. The third stage is also illustrated including a plurality of circumferentially spaced nozzles 22 and buckets 24 mounted on rotor 17. It will be appreciated that the nozzles and buckets lie in the hot gas path 10 of the turbine, the direction of flow of the hot gas through the hot gas path 10 being indicated by the arrow 26.

Figure 2:
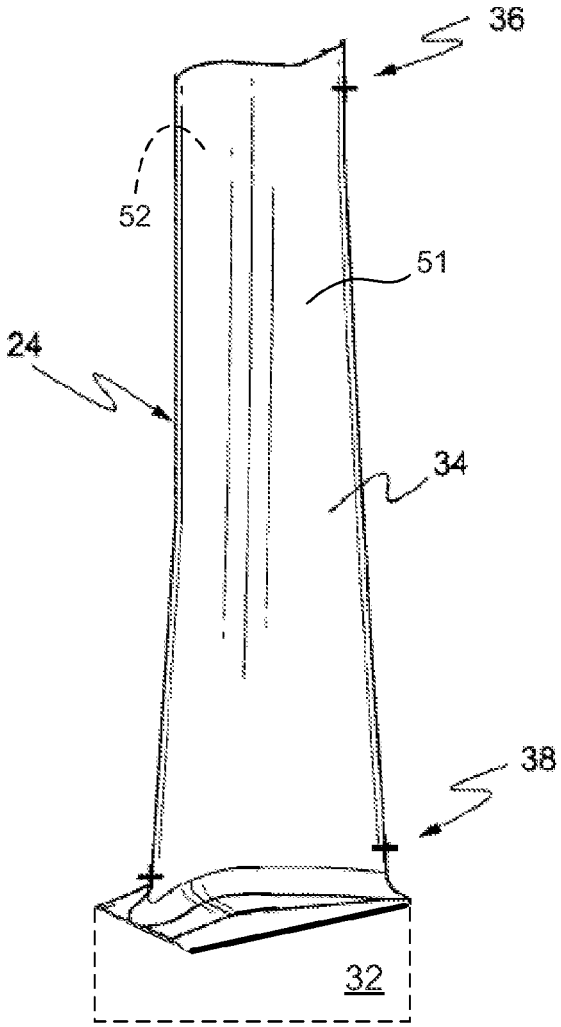
FIG. 2 is a perspective view of a bucket according to an example embodiment of the present invention.

Referring to FIG. 2, it will be appreciated that the buckets have a bucket root 32 mounted on a rotor wheel, not shown in detail, forming part of rotor 17. It will also be appreciated that each bucket 24 has a bucket airfoil 34 as illustrated in FIG. 2. The airfoil 34 has a pressure side 51 and a suction side 52. The pressure side is shown in FIG. 2 and the suction side is located on the opposing side of the airfoil 34. Thus, each of the buckets 24 has a bucket airfoil profile at any cross-section from the bucket platform or root to the bucket tip 36 in the shape of an airfoil 34. The base 38 is at or near the bottom of the airfoil 34 and the tip is at or near the top of the airfoil 34. The base 38 corresponds to the non-dimensional Z value of Table 1 at Z equals 0. The tip 36 of the bucket airfoil corresponds to the non-dimensional Z value of Table 1 at Z equals 100. The Z values are given in percentage values of the airfoil length. As one example only, the height of the turbine bucket or airfoil 34 may be from about 10 inches to about 40 inches. However, it is to be understood that heights below or above this range may also be employed as desired in the specific application.

A gas turbine hot gas path requires airfoils that meet system requirements of aerodynamic and mechanical blade loading and efficiency. To define the airfoil shape of each bucket airfoil, there is a unique set or loci of points in space that meet the stage requirements and can be manufactured. This unique loci of points meets the requirements for stage efficiency and are arrived at by iteration between aerodynamic and mechanical loadings enabling the turbine to run in an efficient, safe and smooth manner. These points are unique and specific to the system and are not obvious to those skilled in the art. The loci which defines the bucket airfoil profile of the invention comprises a set of about 2,200 points with X, Y and Z dimensions relative to a reference origin coordinate system. The Cartesian coordinate system of X, Y and Z values given in Table 1 below defines the profile of the bucket airfoil at various locations along its length. Table 1 lists data for a non-coated airfoil, and the envelope/tolerance for the coordinates is about +/−5% in a direction normal to any airfoil surface location. The point data origin is the leading edge of the root. The coordinate values for the X, Y and Z coordinates are set forth in non-dimensionalized units by the blade height in Table 1 although other units of dimensions may be used when the values are appropriately converted. The Z values set forth in Table 1 are also in non-dimensional form (Z) from 0% to 100% of the blade or airfoil height. To convert the Z value to a Z coordinate value, e.g., in inches, the non-dimensional Z value given in Table 1 is multiplied by the Z length of the airfoil in inches and adding the radius of the airfoil base. As described above, the Cartesian coordinate system has orthogonally-related X, Y and Z axes and the X axis lies generally parallel to the turbine rotor centerline, i.e., the rotary axis and a positive X coordinate value is axial toward the aft, i.e., exhaust end of the turbine. The positive Y coordinate value extends tangentially in the direction of rotation of the rotor and the positive Z coordinate value is radially outwardly toward the bucket tip. All the values in Table 1 are given at room temperature and are unfilleted.

By defining X and Y coordinate values at selected locations in a Z direction normal to the X, Y plane, the profile section or airfoil shape of the bucket airfoil, at each Z distance along the length of the airfoil can be ascertained. By connecting the X and Y values with smooth continuing arcs, each profile section at each distance Z is fixed. The airfoil profiles of the various surface locations between the distances Z are determined by smoothly connecting the adjacent profile sections to one another to form the airfoil profile.

The Table 1 values are generated and shown to three decimal places for determining the profile of the airfoil. As the blade heats up in surface, stress and temperature will cause a change in the X, Y and Z's. Accordingly, the values for the profile given in Table I represent ambient, non-operating or non-hot conditions (e.g., room temperature) and are for an uncoated airfoil.

There are typical manufacturing tolerances as well as coatings which must be accounted for in the actual profile of the airfoil. Each section is joined smoothly with the other sections to form the complete airfoil shape. It will therefore be appreciated that +/− typical manufacturing tolerances, i.e., +/− values, including any coating thicknesses, are additive to the X and Y values given in Table I below. Accordingly, a distance of +/−5% in a direction normal to any surface location along the airfoil profile defines an airfoil profile envelope for this particular bucket airfoil design and turbine, i.e., a range of variation between measured points on the actual airfoil surface at nominal cold or room temperature and the ideal position of those points as given in the Table below at the same temperature. The data is scalable and the geometry pertains to all aerodynamic scales, at, above and/or below 3600 RPM. The bucket airfoil design is robust to this range of variation without impairment of mechanical and aerodynamic functions.

TABLE 1

| N | Location | X | Y | Z |
|---|---|---|---|---|
| 1 | Suction-Side | 0.000 | 0.000 | 0 |
| 2 | Suction-Side | −0.339 | 0.325 | 0 |
| 3 | Suction-Side | −0.496 | 0.771 | 0 |
| 4 | Suction-Side | −0.524 | 1.245 | 0 |
| 5 | Suction-Side | −0.474 | 1.718 | 0 |
| 6 | Suction-Side | −0.376 | 2.183 | 0 |
| 7 | Suction-Side | −0.243 | 2.639 | 0 |
| 8 | Suction-Side | −0.086 | 3.088 | 0 |
| 9 | Suction-Side | 0.091 | 3.530 | 0 |
| 10 | Suction-Side | 0.286 | 3.964 | 0 |
| 11 | Suction-Side | 0.496 | 4.390 | 0 |
| 12 | Suction-Side | 0.719 | 4.810 | 0 |
| 13 | Suction-Side | 0.953 | 5.223 | 0 |
| 14 | Suction-Side | 1.199 | 5.631 | 0 |
| 15 | Suction-Side | 1.454 | 6.032 | 0 |
| 16 | Suction-Side | 1.721 | 6.426 | 0 |
| 17 | Suction-Side | 1.996 | 6.813 | 0 |
| 18 | Suction-Side | 2.282 | 7.194 | 0 |
| 19 | Suction-Side | 2.576 | 7.567 | 0 |
| 20 | Suction-Side | 2.881 | 7.932 | 0 |
| 21 | Suction-Side | 3.195 | 8.289 | 0 |
| 22 | Suction-Side | 3.518 | 8.638 | 0 |
| 23 | Suction-Side | 3.851 | 8.977 | 0 |
| 24 | Suction-Side | 4.195 | 9.307 | 0 |
| 25 | Suction-Side | 4.547 | 9.625 | 0 |
| 26 | Suction-Side | 4.911 | 9.932 | 0 |
| 27 | Suction-Side | 5.284 | 10.227 | 0 |
| 28 | Suction-Side | 5.668 | 10.507 | 0 |
| 29 | Suction-Side | 6.062 | 10.773 | 0 |
| 30 | Suction-Side | 6.468 | 11.021 | 0 |
| 31 | Suction-Side | 6.884 | 11.252 | 0 |
| 32 | Suction-Side | 7.310 | 11.463 | 0 |
| 33 | Suction-Side | 7.746 | 11.653 | 0 |
| 34 | Suction-Side | 8.191 | 11.820 | 0 |
| 35 | Suction-Side | 8.645 | 11.961 | 0 |
| 36 | Suction-Side | 9.106 | 12.075 | 0 |
| 37 | Suction-Side | 9.574 | 12.162 | 0 |
| 38 | Suction-Side | 10.046 | 12.219 | 0 |
| 39 | Suction-Side | 10.521 | 12.246 | 0 |
| 40 | Suction-Side | 10.996 | 12.241 | 0 |
| 41 | Suction-Side | 11.471 | 12.207 | 0 |
| 42 | Suction-Side | 11.941 | 12.142 | 0 |
| 43 | Suction-Side | 12.408 | 12.049 | 0 |
| 44 | Suction-Side | 12.868 | 11.928 | 0 |
| 45 | Suction-Side | 13.320 | 11.781 | 0 |
| 46 | Suction-Side | 13.763 | 11.609 | 0 |
| 47 | Suction-Side | 14.196 | 11.414 | 0 |
| 48 | Suction-Side | 14.621 | 11.199 | 0 |
| 49 | Suction-Side | 15.035 | 10.965 | 0 |
| 50 | Suction-Side | 15.439 | 10.714 | 0 |
| 51 | Suction-Side | 15.832 | 10.447 | 0 |
| 52 | Suction-Side | 16.216 | 10.166 | 0 |
| 53 | Suction-Side | 16.589 | 9.871 | 0 |
| 54 | Suction-Side | 16.953 | 9.565 | 0 |
| 55 | Suction-Side | 17.308 | 9.249 | 0 |
| 56 | Suction-Side | 17.654 | 8.922 | 0 |
| 57 | Suction-Side | 17.991 | 8.587 | 0 |
| 58 | Suction-Side | 18.321 | 8.244 | 0 |
| 59 | Suction-Side | 18.642 | 7.894 | 0 |
| 60 | Suction-Side | 18.956 | 7.537 | 0 |
| 61 | Suction-Side | 19.263 | 7.174 | 0 |
| 62 | Suction-Side | 19.564 | 6.805 | 0 |
| 63 | Suction-Side | 19.858 | 6.432 | 0 |
| 64 | Suction-Side | 20.146 | 6.053 | 0 |
| 65 | Suction-Side | 20.428 | 5.670 | 0 |
| 66 | Suction-Side | 20.704 | 5.284 | 0 |
| 67 | Suction-Side | 20.975 | 4.892 | 0 |
| 68 | Suction-Side | 21.241 | 4.498 | 0 |
| 69 | Suction-Side | 21.501 | 4.100 | 0 |
| 70 | Suction-Side | 21.758 | 3.700 | 0 |
| 71 | Suction-Side | 22.010 | 3.296 | 0 |
| 72 | Suction-Side | 22.257 | 2.891 | 0 |
| 73 | Suction-Side | 22.501 | 2.482 | 0 |

TABLE 1-continued

| N | Location | X | Y | Z |
|---|---|---|---|---|
| 74 | Suction-Side | 22.741 | 2.072 | 0 |
| 75 | Suction-Side | 22.977 | 1.659 | 0 |
| 76 | Suction-Side | 23.209 | 1.244 | 0 |
| 77 | Suction-Side | 23.438 | 0.827 | 0 |
| 78 | Suction-Side | 23.664 | 0.409 | 0 |
| 79 | Suction-Side | 23.886 | −0.012 | 0 |
| 80 | Suction-Side | 24.105 | −0.434 | 0 |
| 81 | Suction-Side | 24.322 | −0.858 | 0 |
| 82 | Suction-Side | 24.535 | −1.283 | 0 |
| 83 | Suction-Side | 24.746 | −1.709 | 0 |
| 84 | Suction-Side | 24.954 | −2.136 | 0 |
| 85 | Suction-Side | 25.159 | −2.566 | 0 |
| 86 | Suction-Side | 25.362 | −2.996 | 0 |
| 87 | Suction-Side | 25.561 | −3.427 | 0 |
| 88 | Suction-Side | 25.759 | −3.860 | 0 |
| 89 | Suction-Side | 25.954 | −4.294 | 0 |
| 90 | Suction-Side | 26.147 | −4.728 | 0 |
| 91 | Suction-Side | 26.338 | −5.164 | 0 |
| 92 | Suction-Side | 26.526 | −5.601 | 0 |
| 93 | Suction-Side | 26.711 | −6.038 | 0 |
| 94 | Suction-Side | 26.895 | −6.477 | 0 |
| 95 | Suction-Side | 27.077 | −6.917 | 0 |
| 96 | Suction-Side | 27.256 | −7.357 | 0 |
| 97 | Suction-Side | 27.433 | −7.798 | 0 |
| 98 | Suction-Side | 27.609 | −8.240 | 0 |
| 99 | Suction-Side | 27.778 | −8.685 | 0 |
| 100 | Suction-Side | 27.753 | −9.151 | 0 |
| 101 | Pressure-Side | 27.445 | −9.501 | 0 |
| 102 | Pressure-Side | 27.120 | −9.589 | 0 |
| 103 | Pressure-Side | 26.794 | −9.511 | 0 |
| 104 | Pressure-Side | 26.542 | −9.287 | 0 |
| 105 | Pressure-Side | 26.350 | −9.007 | 0 |
| 106 | Pressure-Side | 26.158 | −8.727 | 0 |
| 107 | Pressure-Side | 25.966 | −8.447 | 0 |
| 108 | Pressure-Side | 25.773 | −8.169 | 0 |
| 109 | Pressure-Side | 25.579 | −7.890 | 0 |
| 110 | Pressure-Side | 25.384 | −7.612 | 0 |
| 111 | Pressure-Side | 25.189 | −7.334 | 0 |
| 112 | Pressure-Side | 24.993 | −7.057 | 0 |
| 113 | Pressure-Side | 24.796 | −6.780 | 0 |
| 114 | Pressure-Side | 24.599 | −6.505 | 0 |
| 115 | Pressure-Side | 24.401 | −6.229 | 0 |
| 116 | Pressure-Side | 24.201 | −5.955 | 0 |
| 117 | Pressure-Side | 24.001 | −5.681 | 0 |
| 118 | Pressure-Side | 23.799 | −5.408 | 0 |
| 119 | Pressure-Side | 23.596 | −5.136 | 0 |
| 120 | Pressure-Side | 23.392 | −4.865 | 0 |
| 121 | Pressure-Side | 23.186 | −4.594 | 0 |
| 122 | Pressure-Side | 22.979 | −4.326 | 0 |
| 123 | Pressure-Side | 22.771 | −4.058 | 0 |
| 124 | Pressure-Side | 22.561 | −3.791 | 0 |
| 125 | Pressure-Side | 22.349 | −3.526 | 0 |
| 126 | Pressure-Side | 22.136 | −3.262 | 0 |
| 127 | Pressure-Side | 21.921 | −3.000 | 0 |
| 128 | Pressure-Side | 21.703 | −2.739 | 0 |
| 129 | Pressure-Side | 21.484 | −2.480 | 0 |
| 130 | Pressure-Side | 21.262 | −2.223 | 0 |
| 131 | Pressure-Side | 21.039 | −1.968 | 0 |
| 132 | Pressure-Side | 20.813 | −1.715 | 0 |
| 133 | Pressure-Side | 20.585 | −1.463 | 0 |
| 134 | Pressure-Side | 20.354 | −1.214 | 0 |
| 135 | Pressure-Side | 20.120 | −0.968 | 0 |
| 136 | Pressure-Side | 19.884 | −0.725 | 0 |
| 137 | Pressure-Side | 19.644 | −0.484 | 0 |
| 138 | Pressure-Side | 19.402 | −0.247 | 0 |
| 139 | Pressure-Side | 19.156 | −0.013 | 0 |
| 140 | Pressure-Side | 18.907 | 0.218 | 0 |
| 141 | Pressure-Side | 18.655 | 0.445 | 0 |
| 142 | Pressure-Side | 18.399 | 0.668 | 0 |
| 143 | Pressure-Side | 18.140 | 0.887 | 0 |
| 144 | Pressure-Side | 17.877 | 1.102 | 0 |
| 145 | Pressure-Side | 17.610 | 1.311 | 0 |
| 146 | Pressure-Side | 17.339 | 1.516 | 0 |
| 147 | Pressure-Side | 17.064 | 1.714 | 0 |
| 148 | Pressure-Side | 16.784 | 1.907 | 0 |
| 149 | Pressure-Side | 16.500 | 2.093 | 0 |
| 150 | Pressure-Side | 16.212 | 2.272 | 0 |
| 151 | Pressure-Side | 15.920 | 2.444 | 0 |

TABLE 1-continued

| N | Location | X | Y | Z |
|---|---|---|---|---|
| 152 | Pressure-Side | 15.622 | 2.607 | 0 |
| 153 | Pressure-Side | 15.321 | 2.763 | 0 |
| 154 | Pressure-Side | 15.015 | 2.909 | 0 |
| 155 | Pressure-Side | 14.704 | 3.047 | 0 |
| 156 | Pressure-Side | 14.389 | 3.173 | 0 |
| 157 | Pressure-Side | 14.071 | 3.290 | 0 |
| 158 | Pressure-Side | 13.748 | 3.396 | 0 |
| 159 | Pressure-Side | 13.422 | 3.489 | 0 |
| 160 | Pressure-Side | 13.093 | 3.571 | 0 |
| 161 | Pressure-Side | 12.761 | 3.641 | 0 |
| 162 | Pressure-Side | 12.426 | 3.698 | 0 |
| 163 | Pressure-Side | 12.089 | 3.742 | 0 |
| 164 | Pressure-Side | 11.752 | 3.773 | 0 |
| 165 | Pressure-Side | 11.413 | 3.792 | 0 |
| 166 | Pressure-Side | 11.073 | 3.797 | 0 |
| 167 | Pressure-Side | 10.734 | 3.790 | 0 |
| 168 | Pressure-Side | 10.395 | 3.771 | 0 |
| 169 | Pressure-Side | 10.057 | 3.740 | 0 |
| 170 | Pressure-Side | 9.721 | 3.698 | 0 |
| 171 | Pressure-Side | 9.385 | 3.646 | 0 |
| 172 | Pressure-Side | 9.052 | 3.583 | 0 |
| 173 | Pressure-Side | 8.720 | 3.511 | 0 |
| 174 | Pressure-Side | 8.390 | 3.430 | 0 |
| 175 | Pressure-Side | 8.064 | 3.340 | 0 |
| 176 | Pressure-Side | 7.738 | 3.242 | 0 |
| 177 | Pressure-Side | 7.415 | 3.138 | 0 |
| 178 | Pressure-Side | 7.095 | 3.026 | 0 |
| 179 | Pressure-Side | 6.777 | 2.907 | 0 |
| 180 | Pressure-Side | 6.461 | 2.783 | 0 |
| 181 | Pressure-Side | 6.148 | 2.654 | 0 |
| 182 | Pressure-Side | 5.836 | 2.519 | 0 |
| 183 | Pressure-Side | 5.527 | 2.379 | 0 |
| 184 | Pressure-Side | 5.219 | 2.236 | 0 |
| 185 | Pressure-Side | 4.914 | 2.088 | 0 |
| 186 | Pressure-Side | 4.610 | 1.936 | 0 |
| 187 | Pressure-Side | 4.308 | 1.782 | 0 |
| 188 | Pressure-Side | 4.007 | 1.624 | 0 |
| 189 | Pressure-Side | 3.708 | 1.465 | 0 |
| 190 | Pressure-Side | 3.409 | 1.303 | 0 |
| 191 | Pressure-Side | 3.111 | 1.141 | 0 |
| 192 | Pressure-Side | 2.813 | 0.978 | 0 |
| 193 | Pressure-Side | 2.515 | 0.817 | 0 |
| 194 | Pressure-Side | 2.215 | 0.658 | 0 |
| 195 | Pressure-Side | 1.914 | 0.501 | 0 |
| 196 | Pressure-Side | 1.610 | 0.350 | 0 |
| 197 | Pressure-Side | 1.302 | 0.208 | 0 |
| 198 | Pressure-Side | 0.987 | 0.082 | 0 |
| 199 | Pressure-Side | 0.663 | −0.019 | 0 |
| 200 | Pressure-Side | 0.328 | −0.070 | 0 |
| 1 | Suction-Side | 0.483 | 1.845 | 10 |
| 2 | Suction-Side | 0.188 | 2.183 | 10 |
| 3 | Suction-Side | 0.067 | 2.619 | 10 |
| 4 | Suction-Side | 0.063 | 3.072 | 10 |
| 5 | Suction-Side | 0.129 | 3.521 | 10 |
| 6 | Suction-Side | 0.240 | 3.961 | 10 |
| 7 | Suction-Side | 0.382 | 4.392 | 10 |
| 8 | Suction-Side | 0.548 | 4.815 | 10 |
| 9 | Suction-Side | 0.735 | 5.229 | 10 |
| 10 | Suction-Side | 0.939 | 5.635 | 10 |
| 11 | Suction-Side | 1.159 | 6.032 | 10 |
| 12 | Suction-Side | 1.390 | 6.423 | 10 |
| 13 | Suction-Side | 1.633 | 6.806 | 10 |
| 14 | Suction-Side | 1.889 | 7.182 | 10 |
| 15 | Suction-Side | 2.155 | 7.549 | 10 |
| 16 | Suction-Side | 2.432 | 7.910 | 10 |
| 17 | Suction-Side | 2.719 | 8.261 | 10 |
| 18 | Suction-Side | 3.016 | 8.605 | 10 |
| 19 | Suction-Side | 3.323 | 8.940 | 10 |
| 20 | Suction-Side | 3.639 | 9.265 | 10 |
| 21 | Suction-Side | 3.966 | 9.581 | 10 |
| 22 | Suction-Side | 4.303 | 9.885 | 10 |
| 23 | Suction-Side | 4.650 | 10.178 | 10 |
| 24 | Suction-Side | 5.006 | 10.459 | 10 |
| 25 | Suction-Side | 5.373 | 10.727 | 10 |
| 26 | Suction-Side | 5.750 | 10.980 | 10 |
| 27 | Suction-Side | 6.138 | 11.217 | 10 |
| 28 | Suction-Side | 6.535 | 11.437 | 10 |
| 29 | Suction-Side | 6.942 | 11.639 | 10 |

TABLE 1-continued

| N | Location | X | Y | Z |
|---|---|---|---|---|
| 30 | Suction-Side | 7.358 | 11.822 | 10 |
| 31 | Suction-Side | 7.782 | 11.982 | 10 |
| 32 | Suction-Side | 8.215 | 12.120 | 10 |
| 33 | Suction-Side | 8.654 | 12.234 | 10 |
| 34 | Suction-Side | 9.100 | 12.322 | 10 |
| 35 | Suction-Side | 9.550 | 12.383 | 10 |
| 36 | Suction-Side | 10.003 | 12.418 | 10 |
| 37 | Suction-Side | 10.457 | 12.424 | 10 |
| 38 | Suction-Side | 10.910 | 12.402 | 10 |
| 39 | Suction-Side | 11.361 | 12.353 | 10 |
| 40 | Suction-Side | 11.809 | 12.275 | 10 |
| 41 | Suction-Side | 12.251 | 12.172 | 10 |
| 42 | Suction-Side | 12.686 | 12.043 | 10 |
| 43 | Suction-Side | 13.114 | 11.890 | 10 |
| 44 | Suction-Side | 13.533 | 11.715 | 10 |
| 45 | Suction-Side | 13.943 | 11.519 | 10 |
| 46 | Suction-Side | 14.342 | 11.305 | 10 |
| 47 | Suction-Side | 14.733 | 11.072 | 10 |
| 48 | Suction-Side | 15.113 | 10.824 | 10 |
| 49 | Suction-Side | 15.484 | 10.562 | 10 |
| 50 | Suction-Side | 15.845 | 10.286 | 10 |
| 51 | Suction-Side | 16.196 | 9.999 | 10 |
| 52 | Suction-Side | 16.539 | 9.701 | 10 |
| 53 | Suction-Side | 16.872 | 9.392 | 10 |
| 54 | Suction-Side | 17.198 | 9.075 | 10 |
| 55 | Suction-Side | 17.514 | 8.749 | 10 |
| 56 | Suction-Side | 17.823 | 8.417 | 10 |
| 57 | Suction-Side | 18.124 | 8.076 | 10 |
| 58 | Suction-Side | 18.418 | 7.731 | 10 |
| 59 | Suction-Side | 18.706 | 7.379 | 10 |
| 60 | Suction-Side | 18.986 | 7.022 | 10 |
| 61 | Suction-Side | 19.262 | 6.661 | 10 |
| 62 | Suction-Side | 19.531 | 6.296 | 10 |
| 63 | Suction-Side | 19.795 | 5.926 | 10 |
| 64 | Suction-Side | 20.053 | 5.552 | 10 |
| 65 | Suction-Side | 20.307 | 5.176 | 10 |
| 66 | Suction-Side | 20.555 | 4.795 | 10 |
| 67 | Suction-Side | 20.799 | 4.412 | 10 |
| 68 | Suction-Side | 21.039 | 4.026 | 10 |
| 69 | Suction-Side | 21.274 | 3.637 | 10 |
| 70 | Suction-Side | 21.505 | 3.247 | 10 |
| 71 | Suction-Side | 21.732 | 2.854 | 10 |
| 72 | Suction-Side | 21.956 | 2.459 | 10 |
| 73 | Suction-Side | 22.176 | 2.061 | 10 |
| 74 | Suction-Side | 22.393 | 1.663 | 10 |
| 75 | Suction-Side | 22.608 | 1.262 | 10 |
| 76 | Suction-Side | 22.819 | 0.860 | 10 |
| 77 | Suction-Side | 23.026 | 0.456 | 10 |
| 78 | Suction-Side | 23.232 | 0.051 | 10 |
| 79 | Suction-Side | 23.434 | −0.356 | 10 |
| 80 | Suction-Side | 23.634 | −0.764 | 10 |
| 81 | Suction-Side | 23.831 | −1.172 | 10 |
| 82 | Suction-Side | 24.026 | −1.583 | 10 |
| 83 | Suction-Side | 24.219 | −1.993 | 10 |
| 84 | Suction-Side | 24.410 | −2.406 | 10 |
| 85 | Suction-Side | 24.599 | −2.819 | 10 |
| 86 | Suction-Side | 24.785 | −3.233 | 10 |
| 87 | Suction-Side | 24.970 | −3.647 | 10 |
| 88 | Suction-Side | 25.153 | −4.063 | 10 |
| 89 | Suction-Side | 25.334 | −4.480 | 10 |
| 90 | Suction-Side | 25.513 | −4.897 | 10 |
| 91 | Suction-Side | 25.691 | −5.315 | 10 |
| 92 | Suction-Side | 25.867 | −5.734 | 10 |
| 93 | Suction-Side | 26.041 | −6.153 | 10 |
| 94 | Suction-Side | 26.214 | −6.573 | 10 |
| 95 | Suction-Side | 26.386 | −6.993 | 10 |
| 96 | Suction-Side | 26.556 | −7.415 | 10 |
| 97 | Suction-Side | 26.725 | −7.836 | 10 |
| 98 | Suction-Side | 26.893 | −8.258 | 10 |
| 99 | Suction-Side | 27.060 | −8.680 | 10 |
| 100 | Suction-Side | 27.078 | −9.124 | 10 |
| 101 | Pressure-Side | 26.794 | −9.465 | 10 |
| 102 | Pressure-Side | 26.477 | −9.542 | 10 |
| 103 | Pressure-Side | 26.168 | −9.441 | 10 |
| 104 | Pressure-Side | 25.944 | −9.200 | 10 |
| 105 | Pressure-Side | 25.755 | −8.929 | 10 |
| 106 | Pressure-Side | 25.565 | −8.659 | 10 |
| 107 | Pressure-Side | 25.374 | −8.389 | 10 |

TABLE 1-continued

| N | Location | X | Y | Z |
|---|---|---|---|---|
| 108 | Pressure-Side | 25.184 | −8.120 | 10 |
| 109 | Pressure-Side | 24.991 | −7.851 | 10 |
| 110 | Pressure-Side | 24.799 | −7.583 | 10 |
| 111 | Pressure-Side | 24.607 | −7.314 | 10 |
| 112 | Pressure-Side | 24.413 | −7.046 | 10 |
| 113 | Pressure-Side | 24.220 | −6.779 | 10 |
| 114 | Pressure-Side | 24.025 | −6.512 | 10 |
| 115 | Pressure-Side | 23.830 | −6.245 | 10 |
| 116 | Pressure-Side | 23.634 | −5.979 | 10 |
| 117 | Pressure-Side | 23.438 | −5.714 | 10 |
| 118 | Pressure-Side | 23.241 | −5.449 | 10 |
| 119 | Pressure-Side | 23.043 | −5.184 | 10 |
| 120 | Pressure-Side | 22.844 | −4.921 | 10 |
| 121 | Pressure-Side | 22.645 | −4.658 | 10 |
| 122 | Pressure-Side | 22.444 | −4.395 | 10 |
| 123 | Pressure-Side | 22.242 | −4.134 | 10 |
| 124 | Pressure-Side | 22.040 | −3.873 | 10 |
| 125 | Pressure-Side | 21.836 | −3.613 | 10 |
| 126 | Pressure-Side | 21.631 | −3.354 | 10 |
| 127 | Pressure-Side | 21.425 | −3.096 | 10 |
| 128 | Pressure-Side | 21.217 | −2.839 | 10 |
| 129 | Pressure-Side | 21.009 | −2.583 | 10 |
| 130 | Pressure-Side | 20.799 | −2.328 | 10 |
| 131 | Pressure-Side | 20.588 | −2.074 | 10 |
| 132 | Pressure-Side | 20.374 | −1.822 | 10 |
| 133 | Pressure-Side | 20.160 | −1.571 | 10 |
| 134 | Pressure-Side | 19.943 | −1.321 | 10 |
| 135 | Pressure-Side | 19.724 | −1.074 | 10 |
| 136 | Pressure-Side | 19.504 | −0.828 | 10 |
| 137 | Pressure-Side | 19.282 | −0.584 | 10 |
| 138 | Pressure-Side | 19.057 | −0.342 | 10 |
| 139 | Pressure-Side | 18.830 | −0.102 | 10 |
| 140 | Pressure-Side | 18.601 | 0.135 | 10 |
| 141 | Pressure-Side | 18.369 | 0.371 | 10 |
| 142 | Pressure-Side | 18.135 | 0.603 | 10 |
| 143 | Pressure-Side | 17.897 | 0.834 | 10 |
| 144 | Pressure-Side | 17.658 | 1.061 | 10 |
| 145 | Pressure-Side | 17.415 | 1.285 | 10 |
| 146 | Pressure-Side | 17.169 | 1.505 | 10 |
| 147 | Pressure-Side | 16.920 | 1.722 | 10 |
| 148 | Pressure-Side | 16.668 | 1.935 | 10 |
| 149 | Pressure-Side | 16.412 | 2.144 | 10 |
| 150 | Pressure-Side | 16.152 | 2.348 | 10 |
| 151 | Pressure-Side | 15.889 | 2.547 | 10 |
| 152 | Pressure-Side | 15.622 | 2.741 | 10 |
| 153 | Pressure-Side | 15.350 | 2.929 | 10 |
| 154 | Pressure-Side | 15.075 | 3.112 | 10 |
| 155 | Pressure-Side | 14.795 | 3.288 | 10 |
| 156 | Pressure-Side | 14.511 | 3.457 | 10 |
| 157 | Pressure-Side | 14.223 | 3.617 | 10 |
| 158 | Pressure-Side | 13.930 | 3.770 | 10 |
| 159 | Pressure-Side | 13.633 | 3.913 | 10 |
| 160 | Pressure-Side | 13.331 | 4.048 | 10 |
| 161 | Pressure-Side | 13.025 | 4.172 | 10 |
| 162 | Pressure-Side | 12.715 | 4.286 | 10 |
| 163 | Pressure-Side | 12.402 | 4.389 | 10 |
| 164 | Pressure-Side | 12.084 | 4.481 | 10 |
| 165 | Pressure-Side | 11.763 | 4.560 | 10 |
| 166 | Pressure-Side | 11.440 | 4.625 | 10 |
| 167 | Pressure-Side | 11.114 | 4.678 | 10 |
| 168 | Pressure-Side | 10.786 | 4.718 | 10 |
| 169 | Pressure-Side | 10.457 | 4.744 | 10 |
| 170 | Pressure-Side | 10.126 | 4.756 | 10 |
| 171 | Pressure-Side | 9.796 | 4.755 | 10 |
| 172 | Pressure-Side | 9.467 | 4.740 | 10 |
| 173 | Pressure-Side | 9.137 | 4.711 | 10 |
| 174 | Pressure-Side | 8.810 | 4.669 | 10 |
| 175 | Pressure-Side | 8.484 | 4.616 | 10 |
| 176 | Pressure-Side | 8.160 | 4.551 | 10 |
| 177 | Pressure-Side | 7.839 | 4.475 | 10 |
| 178 | Pressure-Side | 7.520 | 4.389 | 10 |
| 179 | Pressure-Side | 7.204 | 4.294 | 10 |
| 180 | Pressure-Side | 6.890 | 4.190 | 10 |
| 181 | Pressure-Side | 6.580 | 4.078 | 10 |
| 182 | Pressure-Side | 6.271 | 3.959 | 10 |
| 183 | Pressure-Side | 5.965 | 3.835 | 10 |
| 184 | Pressure-Side | 5.661 | 3.706 | 10 |
| 185 | Pressure-Side | 5.360 | 3.572 | 10 |

TABLE 1-continued

| N | Location | X | Y | Z |
|---|---|---|---|---|
| 186 | Pressure-Side | 5.059 | 3.434 | 10 |
| 187 | Pressure-Side | 4.761 | 3.293 | 10 |
| 188 | Pressure-Side | 4.463 | 3.150 | 10 |
| 189 | Pressure-Side | 4.166 | 3.006 | 10 |
| 190 | Pressure-Side | 3.869 | 2.860 | 10 |
| 191 | Pressure-Side | 3.572 | 2.715 | 10 |
| 192 | Pressure-Side | 3.276 | 2.570 | 10 |
| 193 | Pressure-Side | 2.978 | 2.428 | 10 |
| 194 | Pressure-Side | 2.678 | 2.288 | 10 |
| 195 | Pressure-Side | 2.377 | 2.154 | 10 |
| 196 | Pressure-Side | 2.072 | 2.027 | 10 |
| 197 | Pressure-Side | 1.762 | 1.913 | 10 |
| 198 | Pressure-Side | 1.446 | 1.818 | 10 |
| 199 | Pressure-Side | 1.122 | 1.751 | 10 |
| 200 | Pressure-Side | 0.794 | 1.742 | 10 |
| 1 | Suction-Side | 0.891 | 3.677 | 20 |
| 2 | Suction-Side | 0.635 | 4.023 | 20 |
| 3 | Suction-Side | 0.542 | 4.446 | 20 |
| 4 | Suction-Side | 0.558 | 4.881 | 20 |
| 5 | Suction-Side | 0.638 | 5.308 | 20 |
| 6 | Suction-Side | 0.759 | 5.726 | 20 |
| 7 | Suction-Side | 0.914 | 6.133 | 20 |
| 8 | Suction-Side | 1.092 | 6.530 | 20 |
| 9 | Suction-Side | 1.291 | 6.918 | 20 |
| 10 | Suction-Side | 1.506 | 7.296 | 20 |
| 11 | Suction-Side | 1.737 | 7.665 | 20 |
| 12 | Suction-Side | 1.981 | 8.025 | 20 |
| 13 | Suction-Side | 2.238 | 8.377 | 20 |
| 14 | Suction-Side | 2.507 | 8.719 | 20 |
| 15 | Suction-Side | 2.787 | 9.052 | 20 |
| 16 | Suction-Side | 3.079 | 9.376 | 20 |
| 17 | Suction-Side | 3.381 | 9.689 | 20 |
| 18 | Suction-Side | 3.693 | 9.993 | 20 |
| 19 | Suction-Side | 4.015 | 10.285 | 20 |
| 20 | Suction-Side | 4.348 | 10.566 | 20 |
| 21 | Suction-Side | 4.691 | 10.834 | 20 |
| 22 | Suction-Side | 5.043 | 11.090 | 20 |
| 23 | Suction-Side | 5.405 | 11.331 | 20 |
| 24 | Suction-Side | 5.777 | 11.557 | 20 |
| 25 | Suction-Side | 6.158 | 11.767 | 20 |
| 26 | Suction-Side | 6.549 | 11.961 | 20 |
| 27 | Suction-Side | 6.947 | 12.135 | 20 |
| 28 | Suction-Side | 7.354 | 12.290 | 20 |
| 29 | Suction-Side | 7.769 | 12.422 | 20 |
| 30 | Suction-Side | 8.190 | 12.533 | 20 |
| 31 | Suction-Side | 8.616 | 12.620 | 20 |
| 32 | Suction-Side | 9.047 | 12.682 | 20 |
| 33 | Suction-Side | 9.481 | 12.718 | 20 |
| 34 | Suction-Side | 9.916 | 12.728 | 20 |
| 35 | Suction-Side | 10.351 | 12.712 | 20 |
| 36 | Suction-Side | 10.784 | 12.669 | 20 |
| 37 | Suction-Side | 11.214 | 12.601 | 20 |
| 38 | Suction-Side | 11.639 | 12.507 | 20 |
| 39 | Suction-Side | 12.059 | 12.390 | 20 |
| 40 | Suction-Side | 12.471 | 12.250 | 20 |
| 41 | Suction-Side | 12.874 | 12.087 | 20 |
| 42 | Suction-Side | 13.270 | 11.905 | 20 |
| 43 | Suction-Side | 13.656 | 11.704 | 20 |
| 44 | Suction-Side | 14.033 | 11.487 | 20 |
| 45 | Suction-Side | 14.400 | 11.253 | 20 |
| 46 | Suction-Side | 14.758 | 11.005 | 20 |
| 47 | Suction-Side | 15.106 | 10.744 | 20 |
| 48 | Suction-Side | 15.445 | 10.471 | 20 |
| 49 | Suction-Side | 15.775 | 10.187 | 20 |
| 50 | Suction-Side | 16.097 | 9.893 | 20 |
| 51 | Suction-Side | 16.409 | 9.591 | 20 |
| 52 | Suction-Side | 16.715 | 9.280 | 20 |
| 53 | Suction-Side | 17.011 | 8.962 | 20 |
| 54 | Suction-Side | 17.301 | 8.637 | 20 |
| 55 | Suction-Side | 17.584 | 8.306 | 20 |
| 56 | Suction-Side | 17.861 | 7.970 | 20 |
| 57 | Suction-Side | 18.130 | 7.628 | 20 |
| 58 | Suction-Side | 18.394 | 7.281 | 20 |
| 59 | Suction-Side | 18.652 | 6.930 | 20 |
| 60 | Suction-Side | 18.904 | 6.576 | 20 |
| 61 | Suction-Side | 19.151 | 6.217 | 20 |
| 62 | Suction-Side | 19.393 | 5.856 | 20 |
| 63 | Suction-Side | 19.631 | 5.491 | 20 |

TABLE 1-continued

| N | Location | X | Y | Z |
|---|---|---|---|---|
| 64 | Suction-Side | 19.864 | 5.124 | 20 |
| 65 | Suction-Side | 20.092 | 4.752 | 20 |
| 66 | Suction-Side | 20.317 | 4.379 | 20 |
| 67 | Suction-Side | 20.537 | 4.004 | 20 |
| 68 | Suction-Side | 20.754 | 3.627 | 20 |
| 69 | Suction-Side | 20.967 | 3.247 | 20 |
| 70 | Suction-Side | 21.176 | 2.866 | 20 |
| 71 | Suction-Side | 21.383 | 2.483 | 20 |
| 72 | Suction-Side | 21.587 | 2.098 | 20 |
| 73 | Suction-Side | 21.788 | 1.711 | 20 |
| 74 | Suction-Side | 21.986 | 1.323 | 20 |
| 75 | Suction-Side | 22.181 | 0.934 | 20 |
| 76 | Suction-Side | 22.373 | 0.544 | 20 |
| 77 | Suction-Side | 22.564 | 0.153 | 20 |
| 78 | Suction-Side | 22.752 | −0.240 | 20 |
| 79 | Suction-Side | 22.938 | −0.634 | 20 |
| 80 | Suction-Side | 23.121 | −1.028 | 20 |
| 81 | Suction-Side | 23.303 | −1.424 | 20 |
| 82 | Suction-Side | 23.483 | −1.820 | 20 |
| 83 | Suction-Side | 23.661 | −2.218 | 20 |
| 84 | Suction-Side | 23.837 | −2.615 | 20 |
| 85 | Suction-Side | 24.012 | −3.014 | 20 |
| 86 | Suction-Side | 24.186 | −3.414 | 20 |
| 87 | Suction-Side | 24.358 | −3.813 | 20 |
| 88 | Suction-Side | 24.528 | −4.214 | 20 |
| 89 | Suction-Side | 24.697 | −4.615 | 20 |
| 90 | Suction-Side | 24.865 | −5.017 | 20 |
| 91 | Suction-Side | 25.032 | −5.419 | 20 |
| 92 | Suction-Side | 25.198 | −5.821 | 20 |
| 93 | Suction-Side | 25.362 | −6.225 | 20 |
| 94 | Suction-Side | 25.526 | −6.628 | 20 |
| 95 | Suction-Side | 25.689 | −7.032 | 20 |
| 96 | Suction-Side | 25.852 | −7.435 | 20 |
| 97 | Suction-Side | 26.013 | −7.839 | 20 |
| 98 | Suction-Side | 26.175 | −8.244 | 20 |
| 99 | Suction-Side | 26.338 | −8.648 | 20 |
| 100 | Suction-Side | 26.387 | −9.071 | 20 |
| 101 | Pressure-Side | 26.124 | −9.403 | 20 |
| 102 | Pressure-Side | 25.812 | −9.467 | 20 |
| 103 | Pressure-Side | 25.518 | −9.343 | 20 |
| 104 | Pressure-Side | 25.315 | −9.092 | 20 |
| 105 | Pressure-Side | 25.128 | −8.829 | 20 |
| 106 | Pressure-Side | 24.940 | −8.565 | 20 |
| 107 | Pressure-Side | 24.753 | −8.301 | 20 |
| 108 | Pressure-Side | 24.564 | −8.038 | 20 |
| 109 | Pressure-Side | 24.375 | −7.776 | 20 |
| 110 | Pressure-Side | 24.186 | −7.513 | 20 |
| 111 | Pressure-Side | 23.997 | −7.251 | 20 |
| 112 | Pressure-Side | 23.807 | −6.989 | 20 |
| 113 | Pressure-Side | 23.617 | −6.728 | 20 |
| 114 | Pressure-Side | 23.426 | −6.466 | 20 |
| 115 | Pressure-Side | 23.235 | −6.204 | 20 |
| 116 | Pressure-Side | 23.044 | −5.944 | 20 |
| 117 | Pressure-Side | 22.852 | −5.683 | 20 |
| 118 | Pressure-Side | 22.660 | −5.423 | 20 |
| 119 | Pressure-Side | 22.467 | −5.163 | 20 |
| 120 | Pressure-Side | 22.274 | −4.904 | 20 |
| 121 | Pressure-Side | 22.080 | −4.645 | 20 |
| 122 | Pressure-Side | 21.885 | −4.386 | 20 |
| 123 | Pressure-Side | 21.690 | −4.128 | 20 |
| 124 | Pressure-Side | 21.495 | −3.870 | 20 |
| 125 | Pressure-Side | 21.298 | −3.613 | 20 |
| 126 | Pressure-Side | 21.101 | −3.357 | 20 |
| 127 | Pressure-Side | 20.903 | −3.101 | 20 |
| 128 | Pressure-Side | 20.704 | −2.846 | 20 |
| 129 | Pressure-Side | 20.505 | −2.591 | 20 |
| 130 | Pressure-Side | 20.304 | −2.337 | 20 |
| 131 | Pressure-Side | 20.104 | −2.084 | 20 |
| 132 | Pressure-Side | 19.901 | −1.831 | 20 |
| 133 | Pressure-Side | 19.698 | −1.579 | 20 |
| 134 | Pressure-Side | 19.493 | −1.329 | 20 |
| 135 | Pressure-Side | 19.288 | −1.079 | 20 |
| 136 | Pressure-Side | 19.081 | −0.830 | 20 |
| 137 | Pressure-Side | 18.873 | −0.583 | 20 |
| 138 | Pressure-Side | 18.662 | −0.336 | 20 |
| 139 | Pressure-Side | 18.451 | −0.092 | 20 |
| 140 | Pressure-Side | 18.238 | 0.152 | 20 |
| 141 | Pressure-Side | 18.023 | 0.394 | 20 |

TABLE 1-continued

| N | Location | X | Y | Z |
|---|---|---|---|---|
| 142 | Pressure-Side | 17.807 | 0.635 | 20 |
| 143 | Pressure-Side | 17.589 | 0.873 | 20 |
| 144 | Pressure-Side | 17.369 | 1.110 | 20 |
| 145 | Pressure-Side | 17.147 | 1.346 | 20 |
| 146 | Pressure-Side | 16.922 | 1.579 | 20 |
| 147 | Pressure-Side | 16.695 | 1.810 | 20 |
| 148 | Pressure-Side | 16.466 | 2.038 | 20 |
| 149 | Pressure-Side | 16.234 | 2.264 | 20 |
| 150 | Pressure-Side | 16.000 | 2.487 | 20 |
| 151 | Pressure-Side | 15.763 | 2.707 | 20 |
| 152 | Pressure-Side | 15.523 | 2.923 | 20 |
| 153 | Pressure-Side | 15.279 | 3.136 | 20 |
| 154 | Pressure-Side | 15.032 | 3.345 | 20 |
| 155 | Pressure-Side | 14.781 | 3.550 | 20 |
| 156 | Pressure-Side | 14.527 | 3.749 | 20 |
| 157 | Pressure-Side | 14.268 | 3.943 | 20 |
| 158 | Pressure-Side | 14.005 | 4.132 | 20 |
| 159 | Pressure-Side | 13.738 | 4.314 | 20 |
| 160 | Pressure-Side | 13.466 | 4.491 | 20 |
| 161 | Pressure-Side | 13.190 | 4.659 | 20 |
| 162 | Pressure-Side | 12.909 | 4.819 | 20 |
| 163 | Pressure-Side | 12.623 | 4.970 | 20 |
| 164 | Pressure-Side | 12.332 | 5.111 | 20 |
| 165 | Pressure-Side | 12.036 | 5.241 | 20 |
| 166 | Pressure-Side | 11.735 | 5.361 | 20 |
| 167 | Pressure-Side | 11.430 | 5.468 | 20 |
| 168 | Pressure-Side | 11.120 | 5.562 | 20 |
| 169 | Pressure-Side | 10.807 | 5.643 | 20 |
| 170 | Pressure-Side | 10.490 | 5.708 | 20 |
| 171 | Pressure-Side | 10.171 | 5.758 | 20 |
| 172 | Pressure-Side | 9.849 | 5.793 | 20 |
| 173 | Pressure-Side | 9.526 | 5.813 | 20 |
| 174 | Pressure-Side | 9.203 | 5.817 | 20 |
| 175 | Pressure-Side | 8.879 | 5.806 | 20 |
| 176 | Pressure-Side | 8.557 | 5.782 | 20 |
| 177 | Pressure-Side | 8.236 | 5.743 | 20 |
| 178 | Pressure-Side | 7.916 | 5.691 | 20 |
| 179 | Pressure-Side | 7.599 | 5.628 | 20 |
| 180 | Pressure-Side | 7.284 | 5.553 | 20 |
| 181 | Pressure-Side | 6.972 | 5.468 | 20 |
| 182 | Pressure-Side | 6.663 | 5.374 | 20 |
| 183 | Pressure-Side | 6.355 | 5.273 | 20 |
| 184 | Pressure-Side | 6.050 | 5.165 | 20 |
| 185 | Pressure-Side | 5.747 | 5.051 | 20 |
| 186 | Pressure-Side | 5.446 | 4.933 | 20 |
| 187 | Pressure-Side | 5.147 | 4.810 | 20 |
| 188 | Pressure-Side | 4.848 | 4.685 | 20 |
| 189 | Pressure-Side | 4.551 | 4.558 | 20 |
| 190 | Pressure-Side | 4.254 | 4.431 | 20 |
| 191 | Pressure-Side | 3.956 | 4.303 | 20 |
| 192 | Pressure-Side | 3.659 | 4.176 | 20 |
| 193 | Pressure-Side | 3.360 | 4.052 | 20 |
| 194 | Pressure-Side | 3.059 | 3.931 | 20 |
| 195 | Pressure-Side | 2.757 | 3.816 | 20 |
| 196 | Pressure-Side | 2.452 | 3.710 | 20 |
| 197 | Pressure-Side | 2.141 | 3.619 | 20 |
| 198 | Pressure-Side | 1.825 | 3.551 | 20 |
| 199 | Pressure-Side | 1.504 | 3.516 | 20 |
| 200 | Pressure-Side | 1.182 | 3.542 | 20 |
| 1 | Suction-Side | 1.171 | 5.420 | 30 |
| 2 | Suction-Side | 0.936 | 5.763 | 30 |
| 3 | Suction-Side | 0.855 | 6.174 | 30 |
| 4 | Suction-Side | 0.875 | 6.593 | 30 |
| 5 | Suction-Side | 0.960 | 7.004 | 30 |
| 6 | Suction-Side | 1.090 | 7.404 | 30 |
| 7 | Suction-Side | 1.251 | 7.792 | 30 |
| 8 | Suction-Side | 1.439 | 8.167 | 30 |
| 9 | Suction-Side | 1.648 | 8.532 | 30 |
| 10 | Suction-Side | 1.875 | 8.885 | 30 |
| 11 | Suction-Side | 2.118 | 9.228 | 30 |
| 12 | Suction-Side | 2.376 | 9.560 | 30 |
| 13 | Suction-Side | 2.648 | 9.880 | 30 |
| 14 | Suction-Side | 2.933 | 10.189 | 30 |
| 15 | Suction-Side | 3.229 | 10.487 | 30 |
| 16 | Suction-Side | 3.538 | 10.772 | 30 |
| 17 | Suction-Side | 3.856 | 11.046 | 30 |
| 18 | Suction-Side | 4.187 | 11.306 | 30 |
| 19 | Suction-Side | 4.527 | 11.553 | 30 |

TABLE 1-continued

| N | Location | X | Y | Z |
|---|---|---|---|---|
| 20 | Suction-Side | 4.876 | 11.785 | 30 |
| 21 | Suction-Side | 5.236 | 12.003 | 30 |
| 22 | Suction-Side | 5.604 | 12.205 | 30 |
| 23 | Suction-Side | 5.981 | 12.390 | 30 |
| 24 | Suction-Side | 6.367 | 12.557 | 30 |
| 25 | Suction-Side | 6.760 | 12.705 | 30 |
| 26 | Suction-Side | 7.161 | 12.834 | 30 |
| 27 | Suction-Side | 7.567 | 12.941 | 30 |
| 28 | Suction-Side | 7.979 | 13.026 | 30 |
| 29 | Suction-Side | 8.394 | 13.089 | 30 |
| 30 | Suction-Side | 8.812 | 13.128 | 30 |
| 31 | Suction-Side | 9.232 | 13.144 | 30 |
| 32 | Suction-Side | 9.652 | 13.134 | 30 |
| 33 | Suction-Side | 10.071 | 13.099 | 30 |
| 34 | Suction-Side | 10.487 | 13.040 | 30 |
| 35 | Suction-Side | 10.899 | 12.958 | 30 |
| 36 | Suction-Side | 11.306 | 12.853 | 30 |
| 37 | Suction-Side | 11.706 | 12.724 | 30 |
| 38 | Suction-Side | 12.098 | 12.575 | 30 |
| 39 | Suction-Side | 12.483 | 12.406 | 30 |
| 40 | Suction-Side | 12.859 | 12.219 | 30 |
| 41 | Suction-Side | 13.227 | 12.014 | 30 |
| 42 | Suction-Side | 13.584 | 11.794 | 30 |
| 43 | Suction-Side | 13.933 | 11.560 | 30 |
| 44 | Suction-Side | 14.272 | 11.312 | 30 |
| 45 | Suction-Side | 14.602 | 11.052 | 30 |
| 46 | Suction-Side | 14.924 | 10.781 | 30 |
| 47 | Suction-Side | 15.237 | 10.501 | 30 |
| 48 | Suction-Side | 15.541 | 10.211 | 30 |
| 49 | Suction-Side | 15.837 | 9.913 | 30 |
| 50 | Suction-Side | 16.127 | 9.608 | 30 |
| 51 | Suction-Side | 16.409 | 9.297 | 30 |
| 52 | Suction-Side | 16.683 | 8.979 | 30 |
| 53 | Suction-Side | 16.950 | 8.654 | 30 |
| 54 | Suction-Side | 17.212 | 8.325 | 30 |
| 55 | Suction-Side | 17.467 | 7.991 | 30 |
| 56 | Suction-Side | 17.715 | 7.652 | 30 |
| 57 | Suction-Side | 17.959 | 7.310 | 30 |
| 58 | Suction-Side | 18.197 | 6.964 | 30 |
| 59 | Suction-Side | 18.431 | 6.614 | 30 |
| 60 | Suction-Side | 18.660 | 6.262 | 30 |
| 61 | Suction-Side | 18.884 | 5.907 | 30 |
| 62 | Suction-Side | 19.104 | 5.549 | 30 |
| 63 | Suction-Side | 19.321 | 5.188 | 30 |
| 64 | Suction-Side | 19.533 | 4.826 | 30 |
| 65 | Suction-Side | 19.742 | 4.461 | 30 |
| 66 | Suction-Side | 19.947 | 4.095 | 30 |
| 67 | Suction-Side | 20.148 | 3.726 | 30 |
| 68 | Suction-Side | 20.347 | 3.355 | 30 |
| 69 | Suction-Side | 20.543 | 2.984 | 30 |
| 70 | Suction-Side | 20.736 | 2.611 | 30 |
| 71 | Suction-Side | 20.927 | 2.236 | 30 |
| 72 | Suction-Side | 21.114 | 1.860 | 30 |
| 73 | Suction-Side | 21.300 | 1.483 | 30 |
| 74 | Suction-Side | 21.483 | 1.104 | 30 |
| 75 | Suction-Side | 21.663 | 0.725 | 30 |
| 76 | Suction-Side | 21.842 | 0.345 | 30 |
| 77 | Suction-Side | 22.019 | −0.036 | 30 |
| 78 | Suction-Side | 22.194 | −0.419 | 30 |
| 79 | Suction-Side | 22.367 | −0.801 | 30 |
| 80 | Suction-Side | 22.539 | −1.185 | 30 |
| 81 | Suction-Side | 22.709 | −1.569 | 30 |
| 82 | Suction-Side | 22.878 | −1.954 | 30 |
| 83 | Suction-Side | 23.044 | −2.339 | 30 |
| 84 | Suction-Side | 23.210 | −2.726 | 30 |
| 85 | Suction-Side | 23.375 | −3.112 | 30 |
| 86 | Suction-Side | 23.539 | −3.499 | 30 |
| 87 | Suction-Side | 23.701 | −3.887 | 30 |
| 88 | Suction-Side | 23.862 | −4.275 | 30 |
| 89 | Suction-Side | 24.023 | −4.663 | 30 |
| 90 | Suction-Side | 24.182 | −5.052 | 30 |
| 91 | Suction-Side | 24.341 | −5.441 | 30 |
| 92 | Suction-Side | 24.500 | −5.831 | 30 |
| 93 | Suction-Side | 24.657 | −6.220 | 30 |
| 94 | Suction-Side | 24.814 | −6.610 | 30 |
| 95 | Suction-Side | 24.971 | −7.000 | 30 |
| 96 | Suction-Side | 25.127 | −7.390 | 30 |
| 97 | Suction-Side | 25.283 | −7.780 | 30 |

TABLE 1-continued

| N | Location | X | Y | Z |
|---|---|---|---|---|
| 98 | Suction-Side | 25.438 | −8.171 | 30 |
| 99 | Suction-Side | 25.593 | −8.561 | 30 |
| 100 | Suction-Side | 25.664 | −8.967 | 30 |
| 101 | Pressure-Side | 25.417 | −9.292 | 30 |
| 102 | Pressure-Side | 25.109 | −9.346 | 30 |
| 103 | Pressure-Side | 24.831 | −9.202 | 30 |
| 104 | Pressure-Side | 24.640 | −8.947 | 30 |
| 105 | Pressure-Side | 24.457 | −8.687 | 30 |
| 106 | Pressure-Side | 24.273 | −8.426 | 30 |
| 107 | Pressure-Side | 24.090 | −8.165 | 30 |
| 108 | Pressure-Side | 23.906 | −7.905 | 30 |
| 109 | Pressure-Side | 23.722 | −7.645 | 30 |
| 110 | Pressure-Side | 23.537 | −7.385 | 30 |
| 111 | Pressure-Side | 23.353 | −7.125 | 30 |
| 112 | Pressure-Side | 23.168 | −6.866 | 30 |
| 113 | Pressure-Side | 22.983 | −6.606 | 30 |
| 114 | Pressure-Side | 22.799 | −6.347 | 30 |
| 115 | Pressure-Side | 22.613 | −6.088 | 30 |
| 116 | Pressure-Side | 22.427 | −5.829 | 30 |
| 117 | Pressure-Side | 22.241 | −5.570 | 30 |
| 118 | Pressure-Side | 22.055 | −5.312 | 30 |
| 119 | Pressure-Side | 21.868 | −5.054 | 30 |
| 120 | Pressure-Side | 21.681 | −4.796 | 30 |
| 121 | Pressure-Side | 21.493 | −4.538 | 30 |
| 122 | Pressure-Side | 21.306 | −4.281 | 30 |
| 123 | Pressure-Side | 21.118 | −4.024 | 30 |
| 124 | Pressure-Side | 20.929 | −3.767 | 30 |
| 125 | Pressure-Side | 20.739 | −3.511 | 30 |
| 126 | Pressure-Side | 20.550 | −3.254 | 30 |
| 127 | Pressure-Side | 20.360 | −2.999 | 30 |
| 128 | Pressure-Side | 20.169 | −2.743 | 30 |
| 129 | Pressure-Side | 19.978 | −2.489 | 30 |
| 130 | Pressure-Side | 19.787 | −2.234 | 30 |
| 131 | Pressure-Side | 19.595 | −1.980 | 30 |
| 132 | Pressure-Side | 19.402 | −1.726 | 30 |
| 133 | Pressure-Side | 19.208 | −1.473 | 30 |
| 134 | Pressure-Side | 19.014 | −1.220 | 30 |
| 135 | Pressure-Side | 18.818 | −0.968 | 30 |
| 136 | Pressure-Side | 18.623 | −0.717 | 30 |
| 137 | Pressure-Side | 18.426 | −0.467 | 30 |
| 138 | Pressure-Side | 18.228 | −0.217 | 30 |
| 139 | Pressure-Side | 18.029 | 0.032 | 30 |
| 140 | Pressure-Side | 17.830 | 0.281 | 30 |
| 141 | Pressure-Side | 17.629 | 0.528 | 30 |
| 142 | Pressure-Side | 17.427 | 0.774 | 30 |
| 143 | Pressure-Side | 17.224 | 1.020 | 30 |
| 144 | Pressure-Side | 17.019 | 1.264 | 30 |
| 145 | Pressure-Side | 16.813 | 1.507 | 30 |
| 146 | Pressure-Side | 16.606 | 1.749 | 30 |
| 147 | Pressure-Side | 16.396 | 1.988 | 30 |
| 148 | Pressure-Side | 16.184 | 2.227 | 30 |
| 149 | Pressure-Side | 15.971 | 2.463 | 30 |
| 150 | Pressure-Side | 15.756 | 2.698 | 30 |
| 151 | Pressure-Side | 15.538 | 2.931 | 30 |
| 152 | Pressure-Side | 15.318 | 3.162 | 30 |
| 153 | Pressure-Side | 15.095 | 3.390 | 30 |
| 154 | Pressure-Side | 14.870 | 3.615 | 30 |
| 155 | Pressure-Side | 14.643 | 3.838 | 30 |
| 156 | Pressure-Side | 14.411 | 4.057 | 30 |
| 157 | Pressure-Side | 14.176 | 4.273 | 30 |
| 158 | Pressure-Side | 13.939 | 4.485 | 30 |
| 159 | Pressure-Side | 13.697 | 4.692 | 30 |
| 160 | Pressure-Side | 13.450 | 4.894 | 30 |
| 161 | Pressure-Side | 13.200 | 5.091 | 30 |
| 162 | Pressure-Side | 12.945 | 5.282 | 30 |
| 163 | Pressure-Side | 12.685 | 5.466 | 30 |
| 164 | Pressure-Side | 12.420 | 5.643 | 30 |
| 165 | Pressure-Side | 12.149 | 5.811 | 30 |
| 166 | Pressure-Side | 11.872 | 5.969 | 30 |
| 167 | Pressure-Side | 11.591 | 6.119 | 30 |
| 168 | Pressure-Side | 11.304 | 6.257 | 30 |
| 169 | Pressure-Side | 11.012 | 6.383 | 30 |
| 170 | Pressure-Side | 10.714 | 6.496 | 30 |
| 171 | Pressure-Side | 10.411 | 6.596 | 30 |
| 172 | Pressure-Side | 10.104 | 6.681 | 30 |
| 173 | Pressure-Side | 9.794 | 6.752 | 30 |
| 174 | Pressure-Side | 9.479 | 6.807 | 30 |
| 175 | Pressure-Side | 9.163 | 6.848 | 30 |

TABLE 1-continued

| N | Location | X | Y | Z |
|---|---|---|---|---|
| 176 | Pressure-Side | 8.846 | 6.874 | 30 |
| 177 | Pressure-Side | 8.528 | 6.884 | 30 |
| 178 | Pressure-Side | 8.209 | 6.880 | 30 |
| 179 | Pressure-Side | 7.891 | 6.862 | 30 |
| 180 | Pressure-Side | 7.574 | 6.831 | 30 |
| 181 | Pressure-Side | 7.259 | 6.787 | 30 |
| 182 | Pressure-Side | 6.945 | 6.733 | 30 |
| 183 | Pressure-Side | 6.632 | 6.668 | 30 |
| 184 | Pressure-Side | 6.322 | 6.594 | 30 |
| 185 | Pressure-Side | 6.015 | 6.511 | 30 |
| 186 | Pressure-Side | 5.709 | 6.422 | 30 |
| 187 | Pressure-Side | 5.405 | 6.326 | 30 |
| 188 | Pressure-Side | 5.103 | 6.225 | 30 |
| 189 | Pressure-Side | 4.802 | 6.119 | 30 |
| 190 | Pressure-Side | 4.503 | 6.011 | 30 |
| 191 | Pressure-Side | 4.204 | 5.900 | 30 |
| 192 | Pressure-Side | 3.905 | 5.789 | 30 |
| 193 | Pressure-Side | 3.607 | 5.678 | 30 |
| 194 | Pressure-Side | 3.307 | 5.570 | 30 |
| 195 | Pressure-Side | 3.005 | 5.468 | 30 |
| 196 | Pressure-Side | 2.700 | 5.375 | 30 |
| 197 | Pressure-Side | 2.392 | 5.295 | 30 |
| 198 | Pressure-Side | 2.079 | 5.237 | 30 |
| 199 | Pressure-Side | 1.761 | 5.218 | 30 |
| 200 | Pressure-Side | 1.447 | 5.265 | 30 |
| 1 | Suction-Side | 1.348 | 7.074 | 40 |
| 2 | Suction-Side | 1.128 | 7.414 | 40 |
| 3 | Suction-Side | 1.049 | 7.813 | 40 |
| 4 | Suction-Side | 1.069 | 8.219 | 40 |
| 5 | Suction-Side | 1.155 | 8.617 | 40 |
| 6 | Suction-Side | 1.291 | 9.002 | 40 |
| 7 | Suction-Side | 1.459 | 9.373 | 40 |
| 8 | Suction-Side | 1.656 | 9.730 | 40 |
| 9 | Suction-Side | 1.876 | 10.073 | 40 |
| 10 | Suction-Side | 2.116 | 10.403 | 40 |
| 11 | Suction-Side | 2.374 | 10.719 | 40 |
| 12 | Suction-Side | 2.647 | 11.022 | 40 |
| 13 | Suction-Side | 2.935 | 11.311 | 40 |
| 14 | Suction-Side | 3.236 | 11.586 | 40 |
| 15 | Suction-Side | 3.550 | 11.846 | 40 |
| 16 | Suction-Side | 3.875 | 12.092 | 40 |
| 17 | Suction-Side | 4.211 | 12.323 | 40 |
| 18 | Suction-Side | 4.558 | 12.538 | 40 |
| 19 | Suction-Side | 4.915 | 12.736 | 40 |
| 20 | Suction-Side | 5.280 | 12.917 | 40 |
| 21 | Suction-Side | 5.653 | 13.080 | 40 |
| 22 | Suction-Side | 6.035 | 13.224 | 40 |
| 23 | Suction-Side | 6.423 | 13.349 | 40 |
| 24 | Suction-Side | 6.817 | 13.453 | 40 |
| 25 | Suction-Side | 7.216 | 13.537 | 40 |
| 26 | Suction-Side | 7.620 | 13.598 | 40 |
| 27 | Suction-Side | 8.025 | 13.638 | 40 |
| 28 | Suction-Side | 8.433 | 13.655 | 40 |
| 29 | Suction-Side | 8.841 | 13.649 | 40 |
| 30 | Suction-Side | 9.248 | 13.620 | 40 |
| 31 | Suction-Side | 9.652 | 13.569 | 40 |
| 32 | Suction-Side | 10.053 | 13.495 | 40 |
| 33 | Suction-Side | 10.449 | 13.399 | 40 |
| 34 | Suction-Side | 10.840 | 13.282 | 40 |
| 35 | Suction-Side | 11.224 | 13.144 | 40 |
| 36 | Suction-Side | 11.601 | 12.988 | 40 |
| 37 | Suction-Side | 11.969 | 12.813 | 40 |
| 38 | Suction-Side | 12.329 | 12.621 | 40 |
| 39 | Suction-Side | 12.680 | 12.414 | 40 |
| 40 | Suction-Side | 13.022 | 12.192 | 40 |
| 41 | Suction-Side | 13.355 | 11.957 | 40 |
| 42 | Suction-Side | 13.679 | 11.709 | 40 |
| 43 | Suction-Side | 13.995 | 11.451 | 40 |
| 44 | Suction-Side | 14.302 | 11.182 | 40 |
| 45 | Suction-Side | 14.600 | 10.904 | 40 |
| 46 | Suction-Side | 14.891 | 10.618 | 40 |
| 47 | Suction-Side | 15.174 | 10.324 | 40 |
| 48 | Suction-Side | 15.450 | 10.023 | 40 |
| 49 | Suction-Side | 15.717 | 9.717 | 40 |
| 50 | Suction-Side | 15.979 | 9.404 | 40 |
| 51 | Suction-Side | 16.235 | 9.086 | 40 |
| 52 | Suction-Side | 16.484 | 8.763 | 40 |
| 53 | Suction-Side | 16.727 | 8.435 | 40 |

TABLE 1-continued

| N | Location | X | Y | Z |
|---|---|---|---|---|
| 54 | Suction-Side | 16.964 | 8.104 | 40 |
| 55 | Suction-Side | 17.197 | 7.768 | 40 |
| 56 | Suction-Side | 17.424 | 7.429 | 40 |
| 57 | Suction-Side | 17.646 | 7.088 | 40 |
| 58 | Suction-Side | 17.864 | 6.743 | 40 |
| 59 | Suction-Side | 18.078 | 6.395 | 40 |
| 60 | Suction-Side | 18.287 | 6.046 | 40 |
| 61 | Suction-Side | 18.494 | 5.694 | 40 |
| 62 | Suction-Side | 18.696 | 5.340 | 40 |
| 63 | Suction-Side | 18.895 | 4.984 | 40 |
| 64 | Suction-Side | 19.091 | 4.626 | 40 |
| 65 | Suction-Side | 19.284 | 4.267 | 40 |
| 66 | Suction-Side | 19.473 | 3.906 | 40 |
| 67 | Suction-Side | 19.661 | 3.543 | 40 |
| 68 | Suction-Side | 19.845 | 3.179 | 40 |
| 69 | Suction-Side | 20.027 | 2.814 | 40 |
| 70 | Suction-Side | 20.207 | 2.449 | 40 |
| 71 | Suction-Side | 20.384 | 2.082 | 40 |
| 72 | Suction-Side | 20.560 | 1.713 | 40 |
| 73 | Suction-Side | 20.734 | 1.344 | 40 |
| 74 | Suction-Side | 20.905 | 0.974 | 40 |
| 75 | Suction-Side | 21.075 | 0.603 | 40 |
| 76 | Suction-Side | 21.243 | 0.232 | 40 |
| 77 | Suction-Side | 21.410 | −0.140 | 40 |
| 78 | Suction-Side | 21.576 | −0.513 | 40 |
| 79 | Suction-Side | 21.740 | −0.887 | 40 |
| 80 | Suction-Side | 21.902 | −1.260 | 40 |
| 81 | Suction-Side | 22.064 | −1.635 | 40 |
| 82 | Suction-Side | 22.225 | −2.010 | 40 |
| 83 | Suction-Side | 22.384 | −2.386 | 40 |
| 84 | Suction-Side | 22.542 | −2.761 | 40 |
| 85 | Suction-Side | 22.699 | −3.138 | 40 |
| 86 | Suction-Side | 22.856 | −3.514 | 40 |
| 87 | Suction-Side | 23.012 | −3.891 | 40 |
| 88 | Suction-Side | 23.167 | −4.268 | 40 |
| 89 | Suction-Side | 23.322 | −4.645 | 40 |
| 90 | Suction-Side | 23.476 | −5.023 | 40 |
| 91 | Suction-Side | 23.628 | −5.401 | 40 |
| 92 | Suction-Side | 23.782 | −5.779 | 40 |
| 93 | Suction-Side | 23.934 | −6.158 | 40 |
| 94 | Suction-Side | 24.086 | −6.536 | 40 |
| 95 | Suction-Side | 24.237 | −6.915 | 40 |
| 96 | Suction-Side | 24.389 | −7.293 | 40 |
| 97 | Suction-Side | 24.540 | −7.673 | 40 |
| 98 | Suction-Side | 24.691 | −8.052 | 40 |
| 99 | Suction-Side | 24.841 | −8.431 | 40 |
| 100 | Suction-Side | 24.916 | −8.823 | 40 |
| 101 | Pressure-Side | 24.679 | −9.139 | 40 |
| 102 | Pressure-Side | 24.373 | −9.182 | 40 |
| 103 | Pressure-Side | 24.106 | −9.026 | 40 |
| 104 | Pressure-Side | 23.924 | −8.768 | 40 |
| 105 | Pressure-Side | 23.746 | −8.508 | 40 |
| 106 | Pressure-Side | 23.569 | −8.248 | 40 |
| 107 | Pressure-Side | 23.391 | −7.987 | 40 |
| 108 | Pressure-Side | 23.212 | −7.727 | 40 |
| 109 | Pressure-Side | 23.035 | −7.467 | 40 |
| 110 | Pressure-Side | 22.857 | −7.207 | 40 |
| 111 | Pressure-Side | 22.678 | −6.947 | 40 |
| 112 | Pressure-Side | 22.500 | −6.687 | 40 |
| 113 | Pressure-Side | 22.322 | −6.427 | 40 |
| 114 | Pressure-Side | 22.143 | −6.167 | 40 |
| 115 | Pressure-Side | 21.964 | −5.907 | 40 |
| 116 | Pressure-Side | 21.785 | −5.647 | 40 |
| 117 | Pressure-Side | 21.606 | −5.388 | 40 |
| 118 | Pressure-Side | 21.427 | −5.129 | 40 |
| 119 | Pressure-Side | 21.247 | −4.870 | 40 |
| 120 | Pressure-Side | 21.068 | −4.610 | 40 |
| 121 | Pressure-Side | 20.888 | −4.352 | 40 |
| 122 | Pressure-Side | 20.708 | −4.093 | 40 |
| 123 | Pressure-Side | 20.527 | −3.835 | 40 |
| 124 | Pressure-Side | 20.346 | −3.576 | 40 |
| 125 | Pressure-Side | 20.165 | −3.319 | 40 |
| 126 | Pressure-Side | 19.983 | −3.061 | 40 |
| 127 | Pressure-Side | 19.801 | −2.804 | 40 |
| 128 | Pressure-Side | 19.618 | −2.546 | 40 |
| 129 | Pressure-Side | 19.435 | −2.290 | 40 |
| 130 | Pressure-Side | 19.252 | −2.033 | 40 |
| 131 | Pressure-Side | 19.068 | −1.777 | 40 |

TABLE 1-continued

| N | Location | X | Y | Z |
|---|---|---|---|---|
| 132 | Pressure-Side | 18.883 | −1.522 | 40 |
| 133 | Pressure-Side | 18.698 | −1.266 | 40 |
| 134 | Pressure-Side | 18.513 | −1.011 | 40 |
| 135 | Pressure-Side | 18.327 | −0.757 | 40 |
| 136 | Pressure-Side | 18.140 | −0.503 | 40 |
| 137 | Pressure-Side | 17.952 | −0.250 | 40 |
| 138 | Pressure-Side | 17.764 | 0.003 | 40 |
| 139 | Pressure-Side | 17.575 | 0.256 | 40 |
| 140 | Pressure-Side | 17.386 | 0.508 | 40 |
| 141 | Pressure-Side | 17.195 | 0.759 | 40 |
| 142 | Pressure-Side | 17.003 | 1.009 | 40 |
| 143 | Pressure-Side | 16.811 | 1.259 | 40 |
| 144 | Pressure-Side | 16.618 | 1.508 | 40 |
| 145 | Pressure-Side | 16.423 | 1.756 | 40 |
| 146 | Pressure-Side | 16.227 | 2.003 | 40 |
| 147 | Pressure-Side | 16.030 | 2.249 | 40 |
| 148 | Pressure-Side | 15.831 | 2.493 | 40 |
| 149 | Pressure-Side | 15.630 | 2.737 | 40 |
| 150 | Pressure-Side | 15.428 | 2.979 | 40 |
| 151 | Pressure-Side | 15.225 | 3.219 | 40 |
| 152 | Pressure-Side | 15.019 | 3.459 | 40 |
| 153 | Pressure-Side | 14.811 | 3.696 | 40 |
| 154 | Pressure-Side | 14.602 | 3.931 | 40 |
| 155 | Pressure-Side | 14.390 | 4.164 | 40 |
| 156 | Pressure-Side | 14.175 | 4.395 | 40 |
| 157 | Pressure-Side | 13.957 | 4.624 | 40 |
| 158 | Pressure-Side | 13.737 | 4.849 | 40 |
| 159 | Pressure-Side | 13.513 | 5.071 | 40 |
| 160 | Pressure-Side | 13.286 | 5.290 | 40 |
| 161 | Pressure-Side | 13.056 | 5.505 | 40 |
| 162 | Pressure-Side | 12.821 | 5.715 | 40 |
| 163 | Pressure-Side | 12.582 | 5.920 | 40 |
| 164 | Pressure-Side | 12.337 | 6.120 | 40 |
| 165 | Pressure-Side | 12.089 | 6.314 | 40 |
| 166 | Pressure-Side | 11.835 | 6.501 | 40 |
| 167 | Pressure-Side | 11.576 | 6.681 | 40 |
| 168 | Pressure-Side | 11.312 | 6.853 | 40 |
| 169 | Pressure-Side | 11.042 | 7.016 | 40 |
| 170 | Pressure-Side | 10.767 | 7.169 | 40 |
| 171 | Pressure-Side | 10.485 | 7.312 | 40 |
| 172 | Pressure-Side | 10.199 | 7.443 | 40 |
| 173 | Pressure-Side | 9.907 | 7.563 | 40 |
| 174 | Pressure-Side | 9.611 | 7.671 | 40 |
| 175 | Pressure-Side | 9.310 | 7.765 | 40 |
| 176 | Pressure-Side | 9.005 | 7.845 | 40 |
| 177 | Pressure-Side | 8.697 | 7.912 | 40 |
| 178 | Pressure-Side | 8.386 | 7.964 | 40 |
| 179 | Pressure-Side | 8.073 | 8.001 | 40 |
| 180 | Pressure-Side | 7.759 | 8.025 | 40 |
| 181 | Pressure-Side | 7.443 | 8.034 | 40 |
| 182 | Pressure-Side | 7.129 | 8.030 | 40 |
| 183 | Pressure-Side | 6.814 | 8.011 | 40 |
| 184 | Pressure-Side | 6.500 | 7.981 | 40 |
| 185 | Pressure-Side | 6.188 | 7.937 | 40 |
| 186 | Pressure-Side | 5.877 | 7.883 | 40 |
| 187 | Pressure-Side | 5.569 | 7.819 | 40 |
| 188 | Pressure-Side | 5.262 | 7.746 | 40 |
| 189 | Pressure-Side | 4.957 | 7.664 | 40 |
| 190 | Pressure-Side | 4.655 | 7.576 | 40 |
| 191 | Pressure-Side | 4.354 | 7.482 | 40 |
| 192 | Pressure-Side | 4.054 | 7.384 | 40 |
| 193 | Pressure-Side | 3.755 | 7.284 | 40 |
| 194 | Pressure-Side | 3.456 | 7.184 | 40 |
| 195 | Pressure-Side | 3.156 | 7.089 | 40 |
| 196 | Pressure-Side | 2.853 | 6.999 | 40 |
| 197 | Pressure-Side | 2.548 | 6.922 | 40 |
| 198 | Pressure-Side | 2.238 | 6.867 | 40 |
| 199 | Pressure-Side | 1.923 | 6.852 | 40 |
| 200 | Pressure-Side | 1.614 | 6.910 | 40 |
| 1 | Suction-Side | 1.468 | 8.661 | 50 |
| 2 | Suction-Side | 1.265 | 8.999 | 50 |
| 3 | Suction-Side | 1.191 | 9.388 | 50 |
| 4 | Suction-Side | 1.218 | 9.783 | 50 |
| 5 | Suction-Side | 1.315 | 10.167 | 50 |
| 6 | Suction-Side | 1.461 | 10.537 | 50 |
| 7 | Suction-Side | 1.644 | 10.889 | 50 |
| 8 | Suction-Side | 1.856 | 11.225 | 50 |
| 9 | Suction-Side | 2.092 | 11.544 | 50 |

TABLE 1-continued

| N | Location | X | Y | Z |
|---|---|---|---|---|
| 10 | Suction-Side | 2.350 | 11.846 | 50 |
| 11 | Suction-Side | 2.625 | 12.132 | 50 |
| 12 | Suction-Side | 2.917 | 12.401 | 50 |
| 13 | Suction-Side | 3.223 | 12.653 | 50 |
| 14 | Suction-Side | 3.542 | 12.890 | 50 |
| 15 | Suction-Side | 3.874 | 13.108 | 50 |
| 16 | Suction-Side | 4.216 | 13.309 | 50 |
| 17 | Suction-Side | 4.569 | 13.492 | 50 |
| 18 | Suction-Side | 4.930 | 13.656 | 50 |
| 19 | Suction-Side | 5.300 | 13.801 | 50 |
| 20 | Suction-Side | 5.677 | 13.925 | 50 |
| 21 | Suction-Side | 6.060 | 14.029 | 50 |
| 22 | Suction-Side | 6.448 | 14.112 | 50 |
| 23 | Suction-Side | 6.841 | 14.174 | 50 |
| 24 | Suction-Side | 7.235 | 14.214 | 50 |
| 25 | Suction-Side | 7.632 | 14.231 | 50 |
| 26 | Suction-Side | 8.029 | 14.227 | 50 |
| 27 | Suction-Side | 8.425 | 14.200 | 50 |
| 28 | Suction-Side | 8.819 | 14.151 | 50 |
| 29 | Suction-Side | 9.210 | 14.081 | 50 |
| 30 | Suction-Side | 9.596 | 13.989 | 50 |
| 31 | Suction-Side | 9.977 | 13.878 | 50 |
| 32 | Suction-Side | 10.352 | 13.746 | 50 |
| 33 | Suction-Side | 10.720 | 13.597 | 50 |
| 34 | Suction-Side | 11.080 | 13.431 | 50 |
| 35 | Suction-Side | 11.432 | 13.248 | 50 |
| 36 | Suction-Side | 11.777 | 13.050 | 50 |
| 37 | Suction-Side | 12.112 | 12.838 | 50 |
| 38 | Suction-Side | 12.440 | 12.613 | 50 |
| 39 | Suction-Side | 12.758 | 12.375 | 50 |
| 40 | Suction-Side | 13.067 | 12.127 | 50 |
| 41 | Suction-Side | 13.369 | 11.868 | 50 |
| 42 | Suction-Side | 13.662 | 11.601 | 50 |
| 43 | Suction-Side | 13.947 | 11.325 | 50 |
| 44 | Suction-Side | 14.225 | 11.041 | 50 |
| 45 | Suction-Side | 14.495 | 10.749 | 50 |
| 46 | Suction-Side | 14.758 | 10.452 | 50 |
| 47 | Suction-Side | 15.014 | 10.149 | 50 |
| 48 | Suction-Side | 15.265 | 9.840 | 50 |
| 49 | Suction-Side | 15.508 | 9.528 | 50 |
| 50 | Suction-Side | 15.747 | 9.210 | 50 |
| 51 | Suction-Side | 15.979 | 8.888 | 50 |
| 52 | Suction-Side | 16.206 | 8.562 | 50 |
| 53 | Suction-Side | 16.429 | 8.233 | 50 |
| 54 | Suction-Side | 16.646 | 7.901 | 50 |
| 55 | Suction-Side | 16.858 | 7.565 | 50 |
| 56 | Suction-Side | 17.066 | 7.227 | 50 |
| 57 | Suction-Side | 17.271 | 6.887 | 50 |
| 58 | Suction-Side | 17.471 | 6.544 | 50 |
| 59 | Suction-Side | 17.668 | 6.200 | 50 |
| 60 | Suction-Side | 17.862 | 5.853 | 50 |
| 61 | Suction-Side | 18.053 | 5.505 | 50 |
| 62 | Suction-Side | 18.240 | 5.155 | 50 |
| 63 | Suction-Side | 18.425 | 4.803 | 50 |
| 64 | Suction-Side | 18.607 | 4.450 | 50 |
| 65 | Suction-Side | 18.787 | 4.096 | 50 |
| 66 | Suction-Side | 18.964 | 3.741 | 50 |
| 67 | Suction-Side | 19.139 | 3.384 | 50 |
| 68 | Suction-Side | 19.312 | 3.027 | 50 |
| 69 | Suction-Side | 19.483 | 2.668 | 50 |
| 70 | Suction-Side | 19.651 | 2.309 | 50 |
| 71 | Suction-Side | 19.819 | 1.949 | 50 |
| 72 | Suction-Side | 19.984 | 1.588 | 50 |
| 73 | Suction-Side | 20.148 | 1.227 | 50 |
| 74 | Suction-Side | 20.311 | 0.865 | 50 |
| 75 | Suction-Side | 20.473 | 0.502 | 50 |
| 76 | Suction-Side | 20.633 | 0.139 | 50 |
| 77 | Suction-Side | 20.791 | −0.226 | 50 |
| 78 | Suction-Side | 20.949 | −0.590 | 50 |
| 79 | Suction-Side | 21.105 | −0.955 | 50 |
| 80 | Suction-Side | 21.262 | −1.320 | 50 |
| 81 | Suction-Side | 21.416 | −1.686 | 50 |
| 82 | Suction-Side | 21.570 | −2.051 | 50 |
| 83 | Suction-Side | 21.724 | −2.418 | 50 |
| 84 | Suction-Side | 21.876 | −2.785 | 50 |
| 85 | Suction-Side | 22.028 | −3.151 | 50 |
| 86 | Suction-Side | 22.179 | −3.519 | 50 |
| 87 | Suction-Side | 22.330 | −3.886 | 50 |

TABLE 1-continued

| N | Location | X | Y | Z |
|---|---|---|---|---|
| 88 | Suction-Side | 22.480 | −4.254 | 50 |
| 89 | Suction-Side | 22.630 | −4.621 | 50 |
| 90 | Suction-Side | 22.779 | −4.989 | 50 |
| 91 | Suction-Side | 22.928 | −5.357 | 50 |
| 92 | Suction-Side | 23.076 | −5.726 | 50 |
| 93 | Suction-Side | 23.224 | −6.094 | 50 |
| 94 | Suction-Side | 23.372 | −6.462 | 50 |
| 95 | Suction-Side | 23.519 | −6.831 | 50 |
| 96 | Suction-Side | 23.666 | −7.200 | 50 |
| 97 | Suction-Side | 23.813 | −7.569 | 50 |
| 98 | Suction-Side | 23.959 | −7.938 | 50 |
| 99 | Suction-Side | 24.106 | −8.307 | 50 |
| 100 | Suction-Side | 24.178 | −8.690 | 50 |
| 101 | Pressure-Side | 23.945 | −8.995 | 50 |
| 102 | Pressure-Side | 23.640 | −9.033 | 50 |
| 103 | Pressure-Side | 23.381 | −8.867 | 50 |
| 104 | Pressure-Side | 23.205 | −8.607 | 50 |
| 105 | Pressure-Side | 23.033 | −8.344 | 50 |
| 106 | Pressure-Side | 22.861 | −8.081 | 50 |
| 107 | Pressure-Side | 22.689 | −7.819 | 50 |
| 108 | Pressure-Side | 22.517 | −7.556 | 50 |
| 109 | Pressure-Side | 22.345 | −7.293 | 50 |
| 110 | Pressure-Side | 22.173 | −7.031 | 50 |
| 111 | Pressure-Side | 22.001 | −6.768 | 50 |
| 112 | Pressure-Side | 21.829 | −6.506 | 50 |
| 113 | Pressure-Side | 21.657 | −6.243 | 50 |
| 114 | Pressure-Side | 21.485 | −5.981 | 50 |
| 115 | Pressure-Side | 21.312 | −5.718 | 50 |
| 116 | Pressure-Side | 21.140 | −5.456 | 50 |
| 117 | Pressure-Side | 20.968 | −5.194 | 50 |
| 118 | Pressure-Side | 20.795 | −4.931 | 50 |
| 119 | Pressure-Side | 20.623 | −4.669 | 50 |
| 120 | Pressure-Side | 20.450 | −4.407 | 50 |
| 121 | Pressure-Side | 20.277 | −4.145 | 50 |
| 122 | Pressure-Side | 20.104 | −3.884 | 50 |
| 123 | Pressure-Side | 19.930 | −3.622 | 50 |
| 124 | Pressure-Side | 19.756 | −3.361 | 50 |
| 125 | Pressure-Side | 19.582 | −3.100 | 50 |
| 126 | Pressure-Side | 19.407 | −2.838 | 50 |
| 127 | Pressure-Side | 19.232 | −2.578 | 50 |
| 128 | Pressure-Side | 19.057 | −2.317 | 50 |
| 129 | Pressure-Side | 18.881 | −2.057 | 50 |
| 130 | Pressure-Side | 18.705 | −1.798 | 50 |
| 131 | Pressure-Side | 18.529 | −1.538 | 50 |
| 132 | Pressure-Side | 18.352 | −1.279 | 50 |
| 133 | Pressure-Side | 18.175 | −1.020 | 50 |
| 134 | Pressure-Side | 17.997 | −0.761 | 50 |
| 135 | Pressure-Side | 17.818 | −0.503 | 50 |
| 136 | Pressure-Side | 17.639 | −0.245 | 50 |
| 137 | Pressure-Side | 17.459 | 0.012 | 50 |
| 138 | Pressure-Side | 17.279 | 0.269 | 50 |
| 139 | Pressure-Side | 17.098 | 0.525 | 50 |
| 140 | Pressure-Side | 16.916 | 0.782 | 50 |
| 141 | Pressure-Side | 16.733 | 1.037 | 50 |
| 142 | Pressure-Side | 16.550 | 1.292 | 50 |
| 143 | Pressure-Side | 16.366 | 1.546 | 50 |
| 144 | Pressure-Side | 16.182 | 1.800 | 50 |
| 145 | Pressure-Side | 15.995 | 2.053 | 50 |
| 146 | Pressure-Side | 15.809 | 2.305 | 50 |
| 147 | Pressure-Side | 15.622 | 2.557 | 50 |
| 148 | Pressure-Side | 15.433 | 2.808 | 50 |
| 149 | Pressure-Side | 15.243 | 3.058 | 50 |
| 150 | Pressure-Side | 15.052 | 3.307 | 50 |
| 151 | Pressure-Side | 14.860 | 3.555 | 50 |
| 152 | Pressure-Side | 14.665 | 3.801 | 50 |
| 153 | Pressure-Side | 14.469 | 4.047 | 50 |
| 154 | Pressure-Side | 14.271 | 4.290 | 50 |
| 155 | Pressure-Side | 14.071 | 4.531 | 50 |
| 156 | Pressure-Side | 13.868 | 4.772 | 50 |
| 157 | Pressure-Side | 13.664 | 5.010 | 50 |
| 158 | Pressure-Side | 13.456 | 5.246 | 50 |
| 159 | Pressure-Side | 13.247 | 5.480 | 50 |
| 160 | Pressure-Side | 13.034 | 5.711 | 50 |
| 161 | Pressure-Side | 12.819 | 5.939 | 50 |
| 162 | Pressure-Side | 12.600 | 6.164 | 50 |
| 163 | Pressure-Side | 12.379 | 6.386 | 50 |
| 164 | Pressure-Side | 12.152 | 6.604 | 50 |
| 165 | Pressure-Side | 11.923 | 6.818 | 50 |

TABLE 1-continued

| N | Location | X | Y | Z |
|---|---|---|---|---|
| 166 | Pressure-Side | 11.689 | 7.027 | 50 |
| 167 | Pressure-Side | 11.451 | 7.231 | 50 |
| 168 | Pressure-Side | 11.207 | 7.429 | 50 |
| 169 | Pressure-Side | 10.959 | 7.622 | 50 |
| 170 | Pressure-Side | 10.706 | 7.807 | 50 |
| 171 | Pressure-Side | 10.447 | 7.986 | 50 |
| 172 | Pressure-Side | 10.184 | 8.156 | 50 |
| 173 | Pressure-Side | 9.915 | 8.317 | 50 |
| 174 | Pressure-Side | 9.640 | 8.469 | 50 |
| 175 | Pressure-Side | 9.360 | 8.610 | 50 |
| 176 | Pressure-Side | 9.074 | 8.739 | 50 |
| 177 | Pressure-Side | 8.782 | 8.857 | 50 |
| 178 | Pressure-Side | 8.486 | 8.960 | 50 |
| 179 | Pressure-Side | 8.186 | 9.051 | 50 |
| 180 | Pressure-Side | 7.881 | 9.127 | 50 |
| 181 | Pressure-Side | 7.573 | 9.187 | 50 |
| 182 | Pressure-Side | 7.263 | 9.233 | 50 |
| 183 | Pressure-Side | 6.950 | 9.262 | 50 |
| 184 | Pressure-Side | 6.636 | 9.276 | 50 |
| 185 | Pressure-Side | 6.322 | 9.274 | 50 |
| 186 | Pressure-Side | 6.009 | 9.257 | 50 |
| 187 | Pressure-Side | 5.697 | 9.227 | 50 |
| 188 | Pressure-Side | 5.385 | 9.184 | 50 |
| 189 | Pressure-Side | 5.077 | 9.129 | 50 |
| 190 | Pressure-Side | 4.770 | 9.064 | 50 |
| 191 | Pressure-Side | 4.465 | 8.989 | 50 |
| 192 | Pressure-Side | 4.162 | 8.907 | 50 |
| 193 | Pressure-Side | 3.860 | 8.819 | 50 |
| 194 | Pressure-Side | 3.560 | 8.729 | 50 |
| 195 | Pressure-Side | 3.259 | 8.639 | 50 |
| 196 | Pressure-Side | 2.958 | 8.553 | 50 |
| 197 | Pressure-Side | 2.652 | 8.478 | 50 |
| 198 | Pressure-Side | 2.343 | 8.427 | 50 |
| 199 | Pressure-Side | 2.029 | 8.414 | 50 |
| 200 | Pressure-Side | 1.725 | 8.484 | 50 |
| 1 | Suction-Side | 1.561 | 10.158 | 60 |
| 2 | Suction-Side | 1.388 | 10.502 | 60 |
| 3 | Suction-Side | 1.338 | 10.885 | 60 |
| 4 | Suction-Side | 1.385 | 11.268 | 60 |
| 5 | Suction-Side | 1.504 | 11.637 | 60 |
| 6 | Suction-Side | 1.673 | 11.984 | 60 |
| 7 | Suction-Side | 1.880 | 12.312 | 60 |
| 8 | Suction-Side | 2.116 | 12.619 | 60 |
| 9 | Suction-Side | 2.376 | 12.906 | 60 |
| 10 | Suction-Side | 2.656 | 13.173 | 60 |
| 11 | Suction-Side | 2.954 | 13.421 | 60 |
| 12 | Suction-Side | 3.266 | 13.649 | 60 |
| 13 | Suction-Side | 3.592 | 13.859 | 60 |
| 14 | Suction-Side | 3.929 | 14.049 | 60 |
| 15 | Suction-Side | 4.277 | 14.219 | 60 |
| 16 | Suction-Side | 4.635 | 14.368 | 60 |
| 17 | Suction-Side | 5.000 | 14.497 | 60 |
| 18 | Suction-Side | 5.371 | 14.604 | 60 |
| 19 | Suction-Side | 5.749 | 14.691 | 60 |
| 20 | Suction-Side | 6.131 | 14.755 | 60 |
| 21 | Suction-Side | 6.516 | 14.798 | 60 |
| 22 | Suction-Side | 6.902 | 14.818 | 60 |
| 23 | Suction-Side | 7.289 | 14.816 | 60 |
| 24 | Suction-Side | 7.676 | 14.792 | 60 |
| 25 | Suction-Side | 8.061 | 14.746 | 60 |
| 26 | Suction-Side | 8.442 | 14.679 | 60 |
| 27 | Suction-Side | 8.819 | 14.590 | 60 |
| 28 | Suction-Side | 9.191 | 14.482 | 60 |
| 29 | Suction-Side | 9.557 | 14.355 | 60 |
| 30 | Suction-Side | 9.916 | 14.211 | 60 |
| 31 | Suction-Side | 10.268 | 14.048 | 60 |
| 32 | Suction-Side | 10.611 | 13.870 | 60 |
| 33 | Suction-Side | 10.948 | 13.677 | 60 |
| 34 | Suction-Side | 11.275 | 13.470 | 60 |
| 35 | Suction-Side | 11.594 | 13.251 | 60 |
| 36 | Suction-Side | 11.905 | 13.020 | 60 |
| 37 | Suction-Side | 12.207 | 12.779 | 60 |
| 38 | Suction-Side | 12.502 | 12.527 | 60 |
| 39 | Suction-Side | 12.789 | 12.266 | 60 |
| 40 | Suction-Side | 13.067 | 11.998 | 60 |
| 41 | Suction-Side | 13.339 | 11.721 | 60 |
| 42 | Suction-Side | 13.602 | 11.438 | 60 |
| 43 | Suction-Side | 13.860 | 11.148 | 60 |

TABLE 1-continued

| N | Location | X | Y | Z |
|---|---|---|---|---|
| 44 | Suction-Side | 14.111 | 10.853 | 60 |
| 45 | Suction-Side | 14.355 | 10.553 | 60 |
| 46 | Suction-Side | 14.593 | 10.248 | 60 |
| 47 | Suction-Side | 14.825 | 9.938 | 60 |
| 48 | Suction-Side | 15.052 | 9.624 | 60 |
| 49 | Suction-Side | 15.275 | 9.307 | 60 |
| 50 | Suction-Side | 15.492 | 8.986 | 60 |
| 51 | Suction-Side | 15.704 | 8.662 | 60 |
| 52 | Suction-Side | 15.912 | 8.336 | 60 |
| 53 | Suction-Side | 16.116 | 8.006 | 60 |
| 54 | Suction-Side | 16.316 | 7.675 | 60 |
| 55 | Suction-Side | 16.512 | 7.340 | 60 |
| 56 | Suction-Side | 16.704 | 7.004 | 60 |
| 57 | Suction-Side | 16.893 | 6.666 | 60 |
| 58 | Suction-Side | 17.079 | 6.326 | 60 |
| 59 | Suction-Side | 17.262 | 5.985 | 60 |
| 60 | Suction-Side | 17.442 | 5.643 | 60 |
| 61 | Suction-Side | 17.620 | 5.298 | 60 |
| 62 | Suction-Side | 17.795 | 4.953 | 60 |
| 63 | Suction-Side | 17.968 | 4.606 | 60 |
| 64 | Suction-Side | 18.139 | 4.258 | 60 |
| 65 | Suction-Side | 18.307 | 3.910 | 60 |
| 66 | Suction-Side | 18.473 | 3.560 | 60 |
| 67 | Suction-Side | 18.638 | 3.209 | 60 |
| 68 | Suction-Side | 18.802 | 2.858 | 60 |
| 69 | Suction-Side | 18.963 | 2.506 | 60 |
| 70 | Suction-Side | 19.123 | 2.154 | 60 |
| 71 | Suction-Side | 19.282 | 1.800 | 60 |
| 72 | Suction-Side | 19.439 | 1.447 | 60 |
| 73 | Suction-Side | 19.595 | 1.092 | 60 |
| 74 | Suction-Side | 19.750 | 0.737 | 60 |
| 75 | Suction-Side | 19.904 | 0.382 | 60 |
| 76 | Suction-Side | 20.057 | 0.026 | 60 |
| 77 | Suction-Side | 20.209 | −0.330 | 60 |
| 78 | Suction-Side | 20.360 | −0.686 | 60 |
| 79 | Suction-Side | 20.511 | −1.043 | 60 |
| 80 | Suction-Side | 20.660 | −1.401 | 60 |
| 81 | Suction-Side | 20.809 | −1.759 | 60 |
| 82 | Suction-Side | 20.957 | −2.116 | 60 |
| 83 | Suction-Side | 21.105 | −2.474 | 60 |
| 84 | Suction-Side | 21.252 | −2.832 | 60 |
| 85 | Suction-Side | 21.399 | −3.191 | 60 |
| 86 | Suction-Side | 21.546 | −3.550 | 60 |
| 87 | Suction-Side | 21.691 | −3.909 | 60 |
| 88 | Suction-Side | 21.836 | −4.268 | 60 |
| 89 | Suction-Side | 21.981 | −4.627 | 60 |
| 90 | Suction-Side | 22.126 | −4.986 | 60 |
| 91 | Suction-Side | 22.270 | −5.345 | 60 |
| 92 | Suction-Side | 22.414 | −5.705 | 60 |
| 93 | Suction-Side | 22.557 | −6.064 | 60 |
| 94 | Suction-Side | 22.701 | −6.424 | 60 |
| 95 | Suction-Side | 22.844 | −6.784 | 60 |
| 96 | Suction-Side | 22.987 | −7.144 | 60 |
| 97 | Suction-Side | 23.129 | −7.504 | 60 |
| 98 | Suction-Side | 23.271 | −7.865 | 60 |
| 99 | Suction-Side | 23.413 | −8.225 | 60 |
| 100 | Suction-Side | 23.474 | −8.599 | 60 |
| 101 | Pressure-Side | 23.242 | −8.893 | 60 |
| 102 | Pressure-Side | 22.935 | −8.927 | 60 |
| 103 | Pressure-Side | 22.680 | −8.753 | 60 |
| 104 | Pressure-Side | 22.511 | −8.488 | 60 |
| 105 | Pressure-Side | 22.345 | −8.220 | 60 |
| 106 | Pressure-Side | 22.178 | −7.953 | 60 |
| 107 | Pressure-Side | 22.012 | −7.685 | 60 |
| 108 | Pressure-Side | 21.846 | −7.418 | 60 |
| 109 | Pressure-Side | 21.679 | −7.150 | 60 |
| 110 | Pressure-Side | 21.513 | −6.883 | 60 |
| 111 | Pressure-Side | 21.347 | −6.615 | 60 |
| 112 | Pressure-Side | 21.181 | −6.348 | 60 |
| 113 | Pressure-Side | 21.016 | −6.080 | 60 |
| 114 | Pressure-Side | 20.850 | −5.813 | 60 |
| 115 | Pressure-Side | 20.683 | −5.545 | 60 |
| 116 | Pressure-Side | 20.517 | −5.278 | 60 |
| 117 | Pressure-Side | 20.351 | −5.010 | 60 |
| 118 | Pressure-Side | 20.184 | −4.743 | 60 |
| 119 | Pressure-Side | 20.017 | −4.476 | 60 |
| 120 | Pressure-Side | 19.850 | −4.209 | 60 |
| 121 | Pressure-Side | 19.683 | −3.942 | 60 |

TABLE 1-continued

| N | Location | X | Y | Z |
|---|---|---|---|---|
| 122 | Pressure-Side | 19.516 | −3.675 | 60 |
| 123 | Pressure-Side | 19.347 | −3.408 | 60 |
| 124 | Pressure-Side | 19.180 | −3.142 | 60 |
| 125 | Pressure-Side | 19.011 | −2.876 | 60 |
| 126 | Pressure-Side | 18.843 | −2.610 | 60 |
| 127 | Pressure-Side | 18.674 | −2.344 | 60 |
| 128 | Pressure-Side | 18.505 | −2.078 | 60 |
| 129 | Pressure-Side | 18.335 | −1.813 | 60 |
| 130 | Pressure-Side | 18.166 | −1.548 | 60 |
| 131 | Pressure-Side | 17.996 | −1.283 | 60 |
| 132 | Pressure-Side | 17.825 | −1.018 | 60 |
| 133 | Pressure-Side | 17.654 | −0.753 | 60 |
| 134 | Pressure-Side | 17.483 | −0.489 | 60 |
| 135 | Pressure-Side | 17.311 | −0.225 | 60 |
| 136 | Pressure-Side | 17.139 | 0.039 | 60 |
| 137 | Pressure-Side | 16.967 | 0.302 | 60 |
| 138 | Pressure-Side | 16.794 | 0.565 | 60 |
| 139 | Pressure-Side | 16.620 | 0.828 | 60 |
| 140 | Pressure-Side | 16.446 | 1.091 | 60 |
| 141 | Pressure-Side | 16.272 | 1.353 | 60 |
| 142 | Pressure-Side | 16.097 | 1.615 | 60 |
| 143 | Pressure-Side | 15.921 | 1.877 | 60 |
| 144 | Pressure-Side | 15.745 | 2.137 | 60 |
| 145 | Pressure-Side | 15.568 | 2.398 | 60 |
| 146 | Pressure-Side | 15.390 | 2.658 | 60 |
| 147 | Pressure-Side | 15.211 | 2.917 | 60 |
| 148 | Pressure-Side | 15.032 | 3.175 | 60 |
| 149 | Pressure-Side | 14.851 | 3.433 | 60 |
| 150 | Pressure-Side | 14.669 | 3.690 | 60 |
| 151 | Pressure-Side | 14.485 | 3.947 | 60 |
| 152 | Pressure-Side | 14.301 | 4.202 | 60 |
| 153 | Pressure-Side | 14.115 | 4.456 | 60 |
| 154 | Pressure-Side | 13.928 | 4.710 | 60 |
| 155 | Pressure-Side | 13.740 | 4.961 | 60 |
| 156 | Pressure-Side | 13.549 | 5.213 | 60 |
| 157 | Pressure-Side | 13.357 | 5.462 | 60 |
| 158 | Pressure-Side | 13.162 | 5.710 | 60 |
| 159 | Pressure-Side | 12.966 | 5.956 | 60 |
| 160 | Pressure-Side | 12.768 | 6.200 | 60 |
| 161 | Pressure-Side | 12.566 | 6.443 | 60 |
| 162 | Pressure-Side | 12.363 | 6.683 | 60 |
| 163 | Pressure-Side | 12.156 | 6.921 | 60 |
| 164 | Pressure-Side | 11.947 | 7.156 | 60 |
| 165 | Pressure-Side | 11.735 | 7.389 | 60 |
| 166 | Pressure-Side | 11.518 | 7.618 | 60 |
| 167 | Pressure-Side | 11.299 | 7.843 | 60 |
| 168 | Pressure-Side | 11.074 | 8.064 | 60 |
| 169 | Pressure-Side | 10.846 | 8.281 | 60 |
| 170 | Pressure-Side | 10.613 | 8.493 | 60 |
| 171 | Pressure-Side | 10.376 | 8.700 | 60 |
| 172 | Pressure-Side | 10.132 | 8.900 | 60 |
| 173 | Pressure-Side | 9.884 | 9.094 | 60 |
| 174 | Pressure-Side | 9.630 | 9.280 | 60 |
| 175 | Pressure-Side | 9.369 | 9.457 | 60 |
| 176 | Pressure-Side | 9.102 | 9.623 | 60 |
| 177 | Pressure-Side | 8.829 | 9.780 | 60 |
| 178 | Pressure-Side | 8.549 | 9.924 | 60 |
| 179 | Pressure-Side | 8.263 | 10.055 | 60 |
| 180 | Pressure-Side | 7.971 | 10.173 | 60 |
| 181 | Pressure-Side | 7.673 | 10.276 | 60 |
| 182 | Pressure-Side | 7.370 | 10.363 | 60 |
| 183 | Pressure-Side | 7.063 | 10.433 | 60 |
| 184 | Pressure-Side | 6.752 | 10.484 | 60 |
| 185 | Pressure-Side | 6.440 | 10.518 | 60 |
| 186 | Pressure-Side | 6.125 | 10.534 | 60 |
| 187 | Pressure-Side | 5.810 | 10.532 | 60 |
| 188 | Pressure-Side | 5.496 | 10.514 | 60 |
| 189 | Pressure-Side | 5.182 | 10.481 | 60 |
| 190 | Pressure-Side | 4.871 | 10.435 | 60 |
| 191 | Pressure-Side | 4.562 | 10.377 | 60 |
| 192 | Pressure-Side | 4.254 | 10.309 | 60 |
| 193 | Pressure-Side | 3.948 | 10.234 | 60 |
| 194 | Pressure-Side | 3.644 | 10.153 | 60 |
| 195 | Pressure-Side | 3.339 | 10.072 | 60 |
| 196 | Pressure-Side | 3.035 | 9.994 | 60 |
| 197 | Pressure-Side | 2.727 | 9.925 | 60 |
| 198 | Pressure-Side | 2.416 | 9.877 | 60 |
| 199 | Pressure-Side | 2.102 | 9.873 | 60 |

TABLE 1-continued

| N | Location | X | Y | Z |
|---|---|---|---|---|
| 200 | Pressure-Side | 1.800 | 9.956 | 60 |
| 1 | Suction-Side | 1.620 | 11.608 | 70 |
| 2 | Suction-Side | 1.487 | 11.961 | 70 |
| 3 | Suction-Side | 1.469 | 12.338 | 70 |
| 4 | Suction-Side | 1.548 | 12.708 | 70 |
| 5 | Suction-Side | 1.699 | 13.055 | 70 |
| 6 | Suction-Side | 1.900 | 13.376 | 70 |
| 7 | Suction-Side | 2.138 | 13.671 | 70 |
| 8 | Suction-Side | 2.404 | 13.941 | 70 |
| 9 | Suction-Side | 2.692 | 14.187 | 70 |
| 10 | Suction-Side | 2.998 | 14.410 | 70 |
| 11 | Suction-Side | 3.320 | 14.610 | 70 |
| 12 | Suction-Side | 3.655 | 14.789 | 70 |
| 13 | Suction-Side | 4.000 | 14.945 | 70 |
| 14 | Suction-Side | 4.355 | 15.079 | 70 |
| 15 | Suction-Side | 4.716 | 15.190 | 70 |
| 16 | Suction-Side | 5.085 | 15.280 | 70 |
| 17 | Suction-Side | 5.458 | 15.347 | 70 |
| 18 | Suction-Side | 5.834 | 15.392 | 70 |
| 19 | Suction-Side | 6.213 | 15.414 | 70 |
| 20 | Suction-Side | 6.592 | 15.413 | 70 |
| 21 | Suction-Side | 6.970 | 15.391 | 70 |
| 22 | Suction-Side | 7.346 | 15.347 | 70 |
| 23 | Suction-Side | 7.719 | 15.281 | 70 |
| 24 | Suction-Side | 8.088 | 15.195 | 70 |
| 25 | Suction-Side | 8.452 | 15.089 | 70 |
| 26 | Suction-Side | 8.810 | 14.964 | 70 |
| 27 | Suction-Side | 9.161 | 14.821 | 70 |
| 28 | Suction-Side | 9.505 | 14.661 | 70 |
| 29 | Suction-Side | 9.840 | 14.486 | 70 |
| 30 | Suction-Side | 10.169 | 14.296 | 70 |
| 31 | Suction-Side | 10.488 | 14.093 | 70 |
| 32 | Suction-Side | 10.800 | 13.876 | 70 |
| 33 | Suction-Side | 11.103 | 13.649 | 70 |
| 34 | Suction-Side | 11.398 | 13.411 | 70 |
| 35 | Suction-Side | 11.685 | 13.163 | 70 |
| 36 | Suction-Side | 11.964 | 12.907 | 70 |
| 37 | Suction-Side | 12.236 | 12.643 | 70 |
| 38 | Suction-Side | 12.501 | 12.372 | 70 |
| 39 | Suction-Side | 12.759 | 12.094 | 70 |
| 40 | Suction-Side | 13.010 | 11.810 | 70 |
| 41 | Suction-Side | 13.254 | 11.520 | 70 |
| 42 | Suction-Side | 13.492 | 11.226 | 70 |
| 43 | Suction-Side | 13.724 | 10.925 | 70 |
| 44 | Suction-Side | 13.951 | 10.621 | 70 |
| 45 | Suction-Side | 14.172 | 10.314 | 70 |
| 46 | Suction-Side | 14.389 | 10.003 | 70 |
| 47 | Suction-Side | 14.600 | 9.689 | 70 |
| 48 | Suction-Side | 14.809 | 9.372 | 70 |
| 49 | Suction-Side | 15.012 | 9.052 | 70 |
| 50 | Suction-Side | 15.211 | 8.730 | 70 |
| 51 | Suction-Side | 15.407 | 8.405 | 70 |
| 52 | Suction-Side | 15.599 | 8.078 | 70 |
| 53 | Suction-Side | 15.788 | 7.750 | 70 |
| 54 | Suction-Side | 15.973 | 7.419 | 70 |
| 55 | Suction-Side | 16.155 | 7.087 | 70 |
| 56 | Suction-Side | 16.334 | 6.752 | 70 |
| 57 | Suction-Side | 16.510 | 6.417 | 70 |
| 58 | Suction-Side | 16.685 | 6.081 | 70 |
| 59 | Suction-Side | 16.857 | 5.743 | 70 |
| 60 | Suction-Side | 17.026 | 5.403 | 70 |
| 61 | Suction-Side | 17.194 | 5.064 | 70 |
| 62 | Suction-Side | 17.359 | 4.723 | 70 |
| 63 | Suction-Side | 17.523 | 4.381 | 70 |
| 64 | Suction-Side | 17.684 | 4.038 | 70 |
| 65 | Suction-Side | 17.845 | 3.694 | 70 |
| 66 | Suction-Side | 18.003 | 3.350 | 70 |
| 67 | Suction-Side | 18.160 | 3.005 | 70 |
| 68 | Suction-Side | 18.315 | 2.660 | 70 |
| 69 | Suction-Side | 18.470 | 2.313 | 70 |
| 70 | Suction-Side | 18.623 | 1.966 | 70 |
| 71 | Suction-Side | 18.775 | 1.619 | 70 |
| 72 | Suction-Side | 18.926 | 1.272 | 70 |
| 73 | Suction-Side | 19.076 | 0.924 | 70 |
| 74 | Suction-Side | 19.225 | 0.575 | 70 |
| 75 | Suction-Side | 19.373 | 0.226 | 70 |
| 76 | Suction-Side | 19.520 | −0.123 | 70 |
| 77 | Suction-Side | 19.667 | −0.473 | 70 |

TABLE 1-continued

| N | Location | X | Y | Z |
|---|---|---|---|---|
| 78 | Suction-Side | 19.813 | −0.822 | 70 |
| 79 | Suction-Side | 19.958 | −1.173 | 70 |
| 80 | Suction-Side | 20.102 | −1.523 | 70 |
| 81 | Suction-Side | 20.246 | −1.874 | 70 |
| 82 | Suction-Side | 20.390 | −2.225 | 70 |
| 83 | Suction-Side | 20.532 | −2.576 | 70 |
| 84 | Suction-Side | 20.675 | −2.927 | 70 |
| 85 | Suction-Side | 20.817 | −3.278 | 70 |
| 86 | Suction-Side | 20.959 | −3.630 | 70 |
| 87 | Suction-Side | 21.099 | −3.982 | 70 |
| 88 | Suction-Side | 21.241 | −4.334 | 70 |
| 89 | Suction-Side | 21.381 | −4.685 | 70 |
| 90 | Suction-Side | 21.521 | −5.038 | 70 |
| 91 | Suction-Side | 21.661 | −5.390 | 70 |
| 92 | Suction-Side | 21.801 | −5.742 | 70 |
| 93 | Suction-Side | 21.941 | −6.095 | 70 |
| 94 | Suction-Side | 22.080 | −6.448 | 70 |
| 95 | Suction-Side | 22.219 | −6.800 | 70 |
| 96 | Suction-Side | 22.357 | −7.153 | 70 |
| 97 | Suction-Side | 22.496 | −7.506 | 70 |
| 98 | Suction-Side | 22.635 | −7.859 | 70 |
| 99 | Suction-Side | 22.772 | −8.212 | 70 |
| 100 | Suction-Side | 22.821 | −8.579 | 70 |
| 101 | Pressure-Side | 22.585 | −8.862 | 70 |
| 102 | Pressure-Side | 22.276 | −8.891 | 70 |
| 103 | Pressure-Side | 22.020 | −8.714 | 70 |
| 104 | Pressure-Side | 21.855 | −8.443 | 70 |
| 105 | Pressure-Side | 21.693 | −8.169 | 70 |
| 106 | Pressure-Side | 21.531 | −7.896 | 70 |
| 107 | Pressure-Side | 21.370 | −7.623 | 70 |
| 108 | Pressure-Side | 21.209 | −7.350 | 70 |
| 109 | Pressure-Side | 21.047 | −7.076 | 70 |
| 110 | Pressure-Side | 20.885 | −6.803 | 70 |
| 111 | Pressure-Side | 20.724 | −6.530 | 70 |
| 112 | Pressure-Side | 20.562 | −6.256 | 70 |
| 113 | Pressure-Side | 20.401 | −5.983 | 70 |
| 114 | Pressure-Side | 20.239 | −5.710 | 70 |
| 115 | Pressure-Side | 20.077 | −5.436 | 70 |
| 116 | Pressure-Side | 19.916 | −5.163 | 70 |
| 117 | Pressure-Side | 19.754 | −4.890 | 70 |
| 118 | Pressure-Side | 19.592 | −4.617 | 70 |
| 119 | Pressure-Side | 19.430 | −4.344 | 70 |
| 120 | Pressure-Side | 19.268 | −4.071 | 70 |
| 121 | Pressure-Side | 19.105 | −3.798 | 70 |
| 122 | Pressure-Side | 18.943 | −3.526 | 70 |
| 123 | Pressure-Side | 18.780 | −3.253 | 70 |
| 124 | Pressure-Side | 18.617 | −2.980 | 70 |
| 125 | Pressure-Side | 18.454 | −2.708 | 70 |
| 126 | Pressure-Side | 18.291 | −2.435 | 70 |
| 127 | Pressure-Side | 18.128 | −2.163 | 70 |
| 128 | Pressure-Side | 17.964 | −1.891 | 70 |
| 129 | Pressure-Side | 17.800 | −1.619 | 70 |
| 130 | Pressure-Side | 17.637 | −1.347 | 70 |
| 131 | Pressure-Side | 17.473 | −1.075 | 70 |
| 132 | Pressure-Side | 17.308 | −0.803 | 70 |
| 133 | Pressure-Side | 17.144 | −0.532 | 70 |
| 134 | Pressure-Side | 16.979 | −0.261 | 70 |
| 135 | Pressure-Side | 16.814 | 0.011 | 70 |
| 136 | Pressure-Side | 16.649 | 0.282 | 70 |
| 137 | Pressure-Side | 16.483 | 0.553 | 70 |
| 138 | Pressure-Side | 16.318 | 0.824 | 70 |
| 139 | Pressure-Side | 16.151 | 1.094 | 70 |
| 140 | Pressure-Side | 15.985 | 1.365 | 70 |
| 141 | Pressure-Side | 15.818 | 1.635 | 70 |
| 142 | Pressure-Side | 15.651 | 1.905 | 70 |
| 143 | Pressure-Side | 15.483 | 2.175 | 70 |
| 144 | Pressure-Side | 15.315 | 2.444 | 70 |
| 145 | Pressure-Side | 15.147 | 2.713 | 70 |
| 146 | Pressure-Side | 14.977 | 2.982 | 70 |
| 147 | Pressure-Side | 14.807 | 3.250 | 70 |
| 148 | Pressure-Side | 14.637 | 3.517 | 70 |
| 149 | Pressure-Side | 14.466 | 3.785 | 70 |
| 150 | Pressure-Side | 14.293 | 4.051 | 70 |
| 151 | Pressure-Side | 14.120 | 4.318 | 70 |
| 152 | Pressure-Side | 13.946 | 4.583 | 70 |
| 153 | Pressure-Side | 13.771 | 4.848 | 70 |
| 154 | Pressure-Side | 13.594 | 5.112 | 70 |
| 155 | Pressure-Side | 13.417 | 5.375 | 70 |

TABLE 1-continued

| N | Location | X | Y | Z |
|---|---|---|---|---|
| 156 | Pressure-Side | 13.237 | 5.637 | 70 |
| 157 | Pressure-Side | 13.057 | 5.898 | 70 |
| 158 | Pressure-Side | 12.875 | 6.159 | 70 |
| 159 | Pressure-Side | 12.692 | 6.417 | 70 |
| 160 | Pressure-Side | 12.506 | 6.675 | 70 |
| 161 | Pressure-Side | 12.318 | 6.931 | 70 |
| 162 | Pressure-Side | 12.128 | 7.186 | 70 |
| 163 | Pressure-Side | 11.936 | 7.439 | 70 |
| 164 | Pressure-Side | 11.741 | 7.689 | 70 |
| 165 | Pressure-Side | 11.544 | 7.938 | 70 |
| 166 | Pressure-Side | 11.343 | 8.184 | 70 |
| 167 | Pressure-Side | 11.138 | 8.427 | 70 |
| 168 | Pressure-Side | 10.931 | 8.667 | 70 |
| 169 | Pressure-Side | 10.719 | 8.904 | 70 |
| 170 | Pressure-Side | 10.504 | 9.137 | 70 |
| 171 | Pressure-Side | 10.283 | 9.365 | 70 |
| 172 | Pressure-Side | 10.057 | 9.589 | 70 |
| 173 | Pressure-Side | 9.827 | 9.806 | 70 |
| 174 | Pressure-Side | 9.590 | 10.018 | 70 |
| 175 | Pressure-Side | 9.347 | 10.222 | 70 |
| 176 | Pressure-Side | 9.097 | 10.418 | 70 |
| 177 | Pressure-Side | 8.841 | 10.605 | 70 |
| 178 | Pressure-Side | 8.576 | 10.781 | 70 |
| 179 | Pressure-Side | 8.305 | 10.946 | 70 |
| 180 | Pressure-Side | 8.026 | 11.098 | 70 |
| 181 | Pressure-Side | 7.740 | 11.236 | 70 |
| 182 | Pressure-Side | 7.447 | 11.358 | 70 |
| 183 | Pressure-Side | 7.147 | 11.463 | 70 |
| 184 | Pressure-Side | 6.842 | 11.550 | 70 |
| 185 | Pressure-Side | 6.532 | 11.619 | 70 |
| 186 | Pressure-Side | 6.219 | 11.668 | 70 |
| 187 | Pressure-Side | 5.902 | 11.698 | 70 |
| 188 | Pressure-Side | 5.586 | 11.709 | 70 |
| 189 | Pressure-Side | 5.268 | 11.704 | 70 |
| 190 | Pressure-Side | 4.951 | 11.682 | 70 |
| 191 | Pressure-Side | 4.636 | 11.646 | 70 |
| 192 | Pressure-Side | 4.322 | 11.598 | 70 |
| 193 | Pressure-Side | 4.010 | 11.541 | 70 |
| 194 | Pressure-Side | 3.698 | 11.477 | 70 |
| 195 | Pressure-Side | 3.388 | 11.411 | 70 |
| 196 | Pressure-Side | 3.077 | 11.347 | 70 |
| 197 | Pressure-Side | 2.764 | 11.292 | 70 |
| 198 | Pressure-Side | 2.449 | 11.260 | 70 |
| 199 | Pressure-Side | 2.132 | 11.271 | 70 |
| 200 | Pressure-Side | 1.835 | 11.378 | 70 |
| 1 | Suction-Side | 1.645 | 13.043 | 80 |
| 2 | Suction-Side | 1.557 | 13.403 | 80 |
| 3 | Suction-Side | 1.581 | 13.773 | 80 |
| 4 | Suction-Side | 1.699 | 14.125 | 80 |
| 5 | Suction-Side | 1.888 | 14.445 | 80 |
| 6 | Suction-Side | 2.126 | 14.730 | 80 |
| 7 | Suction-Side | 2.400 | 14.983 | 80 |
| 8 | Suction-Side | 2.698 | 15.205 | 80 |
| 9 | Suction-Side | 3.016 | 15.399 | 80 |
| 10 | Suction-Side | 3.349 | 15.565 | 80 |
| 11 | Suction-Side | 3.693 | 15.706 | 80 |
| 12 | Suction-Side | 4.047 | 15.823 | 80 |
| 13 | Suction-Side | 4.408 | 15.914 | 80 |
| 14 | Suction-Side | 4.773 | 15.983 | 80 |
| 15 | Suction-Side | 5.143 | 16.027 | 80 |
| 16 | Suction-Side | 5.514 | 16.049 | 80 |
| 17 | Suction-Side | 5.886 | 16.048 | 80 |
| 18 | Suction-Side | 6.258 | 16.024 | 80 |
| 19 | Suction-Side | 6.627 | 15.979 | 80 |
| 20 | Suction-Side | 6.993 | 15.913 | 80 |
| 21 | Suction-Side | 7.356 | 15.826 | 80 |
| 22 | Suction-Side | 7.712 | 15.719 | 80 |
| 23 | Suction-Side | 8.062 | 15.594 | 80 |
| 24 | Suction-Side | 8.406 | 15.450 | 80 |
| 25 | Suction-Side | 8.742 | 15.291 | 80 |
| 26 | Suction-Side | 9.070 | 15.115 | 80 |
| 27 | Suction-Side | 9.390 | 14.925 | 80 |
| 28 | Suction-Side | 9.703 | 14.722 | 80 |
| 29 | Suction-Side | 10.006 | 14.507 | 80 |
| 30 | Suction-Side | 10.301 | 14.280 | 80 |
| 31 | Suction-Side | 10.589 | 14.044 | 80 |
| 32 | Suction-Side | 10.869 | 13.798 | 80 |
| 33 | Suction-Side | 11.140 | 13.544 | 80 |

TABLE 1-continued

| N | Location | X | Y | Z |
|---|---|---|---|---|
| 34 | Suction-Side | 11.405 | 13.282 | 80 |
| 35 | Suction-Side | 11.663 | 13.014 | 80 |
| 36 | Suction-Side | 11.914 | 12.739 | 80 |
| 37 | Suction-Side | 12.158 | 12.458 | 80 |
| 38 | Suction-Side | 12.396 | 12.172 | 80 |
| 39 | Suction-Side | 12.629 | 11.881 | 80 |
| 40 | Suction-Side | 12.855 | 11.586 | 80 |
| 41 | Suction-Side | 13.076 | 11.286 | 80 |
| 42 | Suction-Side | 13.292 | 10.983 | 80 |
| 43 | Suction-Side | 13.503 | 10.676 | 80 |
| 44 | Suction-Side | 13.710 | 10.367 | 80 |
| 45 | Suction-Side | 13.913 | 10.055 | 80 |
| 46 | Suction-Side | 14.112 | 9.741 | 80 |
| 47 | Suction-Side | 14.308 | 9.424 | 80 |
| 48 | Suction-Side | 14.499 | 9.104 | 80 |
| 49 | Suction-Side | 14.687 | 8.784 | 80 |
| 50 | Suction-Side | 14.873 | 8.461 | 80 |
| 51 | Suction-Side | 15.055 | 8.136 | 80 |
| 52 | Suction-Side | 15.235 | 7.810 | 80 |
| 53 | Suction-Side | 15.411 | 7.482 | 80 |
| 54 | Suction-Side | 15.585 | 7.153 | 80 |
| 55 | Suction-Side | 15.756 | 6.823 | 80 |
| 56 | Suction-Side | 15.926 | 6.491 | 80 |
| 57 | Suction-Side | 16.093 | 6.159 | 80 |
| 58 | Suction-Side | 16.259 | 5.825 | 80 |
| 59 | Suction-Side | 16.422 | 5.491 | 80 |
| 60 | Suction-Side | 16.583 | 5.156 | 80 |
| 61 | Suction-Side | 16.743 | 4.819 | 80 |
| 62 | Suction-Side | 16.902 | 4.483 | 80 |
| 63 | Suction-Side | 17.058 | 4.145 | 80 |
| 64 | Suction-Side | 17.214 | 3.807 | 80 |
| 65 | Suction-Side | 17.368 | 3.468 | 80 |
| 66 | Suction-Side | 17.520 | 3.128 | 80 |
| 67 | Suction-Side | 17.672 | 2.788 | 80 |
| 68 | Suction-Side | 17.822 | 2.448 | 80 |
| 69 | Suction-Side | 17.972 | 2.107 | 80 |
| 70 | Suction-Side | 18.120 | 1.765 | 80 |
| 71 | Suction-Side | 18.268 | 1.424 | 80 |
| 72 | Suction-Side | 18.414 | 1.082 | 80 |
| 73 | Suction-Side | 18.560 | 0.739 | 80 |
| 74 | Suction-Side | 18.704 | 0.396 | 80 |
| 75 | Suction-Side | 18.848 | 0.053 | 80 |
| 76 | Suction-Side | 18.992 | −0.291 | 80 |
| 77 | Suction-Side | 19.134 | −0.634 | 80 |
| 78 | Suction-Side | 19.276 | −0.978 | 80 |
| 79 | Suction-Side | 19.418 | −1.323 | 80 |
| 80 | Suction-Side | 19.559 | −1.668 | 80 |
| 81 | Suction-Side | 19.699 | −2.013 | 80 |
| 82 | Suction-Side | 19.839 | −2.357 | 80 |
| 83 | Suction-Side | 19.978 | −2.702 | 80 |
| 84 | Suction-Side | 20.117 | −3.048 | 80 |
| 85 | Suction-Side | 20.256 | −3.394 | 80 |
| 86 | Suction-Side | 20.394 | −3.739 | 80 |
| 87 | Suction-Side | 20.532 | −4.085 | 80 |
| 88 | Suction-Side | 20.669 | −4.431 | 80 |
| 89 | Suction-Side | 20.806 | −4.777 | 80 |
| 90 | Suction-Side | 20.943 | −5.123 | 80 |
| 91 | Suction-Side | 21.079 | −5.469 | 80 |
| 92 | Suction-Side | 21.215 | −5.816 | 80 |
| 93 | Suction-Side | 21.351 | −6.162 | 80 |
| 94 | Suction-Side | 21.487 | −6.509 | 80 |
| 95 | Suction-Side | 21.623 | −6.855 | 80 |
| 96 | Suction-Side | 21.758 | −7.202 | 80 |
| 97 | Suction-Side | 21.894 | −7.549 | 80 |
| 98 | Suction-Side | 22.029 | −7.896 | 80 |
| 99 | Suction-Side | 22.166 | −8.242 | 80 |
| 100 | Suction-Side | 22.191 | −8.605 | 80 |
| 101 | Pressure-Side | 21.951 | −8.875 | 80 |
| 102 | Pressure-Side | 21.638 | −8.906 | 80 |
| 103 | Pressure-Side | 21.378 | −8.728 | 80 |
| 104 | Pressure-Side | 21.217 | −8.451 | 80 |
| 105 | Pressure-Side | 21.059 | −8.171 | 80 |
| 106 | Pressure-Side | 20.902 | −7.892 | 80 |
| 107 | Pressure-Side | 20.744 | −7.613 | 80 |
| 108 | Pressure-Side | 20.586 | −7.334 | 80 |
| 109 | Pressure-Side | 20.428 | −7.055 | 80 |
| 110 | Pressure-Side | 20.271 | −6.776 | 80 |
| 111 | Pressure-Side | 20.113 | −6.496 | 80 |

TABLE 1-continued

| N | Location | X | Y | Z |
|---|---|---|---|---|
| 112 | Pressure-Side | 19.956 | −6.217 | 80 |
| 113 | Pressure-Side | 19.797 | −5.938 | 80 |
| 114 | Pressure-Side | 19.640 | −5.659 | 80 |
| 115 | Pressure-Side | 19.482 | −5.379 | 80 |
| 116 | Pressure-Side | 19.325 | −5.100 | 80 |
| 117 | Pressure-Side | 19.167 | −4.821 | 80 |
| 118 | Pressure-Side | 19.009 | −4.542 | 80 |
| 119 | Pressure-Side | 18.851 | −4.262 | 80 |
| 120 | Pressure-Side | 18.693 | −3.983 | 80 |
| 121 | Pressure-Side | 18.535 | −3.704 | 80 |
| 122 | Pressure-Side | 18.378 | −3.425 | 80 |
| 123 | Pressure-Side | 18.220 | −3.146 | 80 |
| 124 | Pressure-Side | 18.062 | −2.866 | 80 |
| 125 | Pressure-Side | 17.903 | −2.588 | 80 |
| 126 | Pressure-Side | 17.745 | −2.309 | 80 |
| 127 | Pressure-Side | 17.587 | −2.029 | 80 |
| 128 | Pressure-Side | 17.429 | −1.751 | 80 |
| 129 | Pressure-Side | 17.271 | −1.471 | 80 |
| 130 | Pressure-Side | 17.113 | −1.193 | 80 |
| 131 | Pressure-Side | 16.954 | −0.914 | 80 |
| 132 | Pressure-Side | 16.796 | −0.635 | 80 |
| 133 | Pressure-Side | 16.638 | −0.356 | 80 |
| 134 | Pressure-Side | 16.479 | −0.078 | 80 |
| 135 | Pressure-Side | 16.320 | 0.202 | 80 |
| 136 | Pressure-Side | 16.161 | 0.480 | 80 |
| 137 | Pressure-Side | 16.002 | 0.758 | 80 |
| 138 | Pressure-Side | 15.843 | 1.037 | 80 |
| 139 | Pressure-Side | 15.684 | 1.315 | 80 |
| 140 | Pressure-Side | 15.525 | 1.593 | 80 |
| 141 | Pressure-Side | 15.365 | 1.872 | 80 |
| 142 | Pressure-Side | 15.205 | 2.150 | 80 |
| 143 | Pressure-Side | 15.045 | 2.428 | 80 |
| 144 | Pressure-Side | 14.884 | 2.706 | 80 |
| 145 | Pressure-Side | 14.724 | 2.983 | 80 |
| 146 | Pressure-Side | 14.563 | 3.260 | 80 |
| 147 | Pressure-Side | 14.401 | 3.537 | 80 |
| 148 | Pressure-Side | 14.239 | 3.813 | 80 |
| 149 | Pressure-Side | 14.076 | 4.090 | 80 |
| 150 | Pressure-Side | 13.912 | 4.366 | 80 |
| 151 | Pressure-Side | 13.748 | 4.641 | 80 |
| 152 | Pressure-Side | 13.583 | 4.917 | 80 |
| 153 | Pressure-Side | 13.417 | 5.191 | 80 |
| 154 | Pressure-Side | 13.250 | 5.465 | 80 |
| 155 | Pressure-Side | 13.083 | 5.738 | 80 |
| 156 | Pressure-Side | 12.913 | 6.011 | 80 |
| 157 | Pressure-Side | 12.744 | 6.283 | 80 |
| 158 | Pressure-Side | 12.572 | 6.554 | 80 |
| 159 | Pressure-Side | 12.400 | 6.824 | 80 |
| 160 | Pressure-Side | 12.225 | 7.093 | 80 |
| 161 | Pressure-Side | 12.050 | 7.362 | 80 |
| 162 | Pressure-Side | 11.872 | 7.628 | 80 |
| 163 | Pressure-Side | 11.692 | 7.894 | 80 |
| 164 | Pressure-Side | 11.509 | 8.157 | 80 |
| 165 | Pressure-Side | 11.324 | 8.419 | 80 |
| 166 | Pressure-Side | 11.135 | 8.678 | 80 |
| 167 | Pressure-Side | 10.944 | 8.936 | 80 |
| 168 | Pressure-Side | 10.749 | 9.190 | 80 |
| 169 | Pressure-Side | 10.550 | 9.442 | 80 |
| 170 | Pressure-Side | 10.347 | 9.690 | 80 |
| 171 | Pressure-Side | 10.140 | 9.936 | 80 |
| 172 | Pressure-Side | 9.929 | 10.177 | 80 |
| 173 | Pressure-Side | 9.713 | 10.414 | 80 |
| 174 | Pressure-Side | 9.490 | 10.645 | 80 |
| 175 | Pressure-Side | 9.262 | 10.870 | 80 |
| 176 | Pressure-Side | 9.027 | 11.088 | 80 |
| 177 | Pressure-Side | 8.785 | 11.299 | 80 |
| 178 | Pressure-Side | 8.536 | 11.501 | 80 |
| 179 | Pressure-Side | 8.279 | 11.692 | 80 |
| 180 | Pressure-Side | 8.014 | 11.873 | 80 |
| 181 | Pressure-Side | 7.740 | 12.041 | 80 |
| 182 | Pressure-Side | 7.459 | 12.194 | 80 |
| 183 | Pressure-Side | 7.169 | 12.331 | 80 |
| 184 | Pressure-Side | 6.872 | 12.452 | 80 |
| 185 | Pressure-Side | 6.568 | 12.554 | 80 |
| 186 | Pressure-Side | 6.259 | 12.638 | 80 |
| 187 | Pressure-Side | 5.945 | 12.702 | 80 |
| 188 | Pressure-Side | 5.627 | 12.748 | 80 |
| 189 | Pressure-Side | 5.308 | 12.777 | 80 |

TABLE 1-continued

| N | Location | X | Y | Z |
|---|---|---|---|---|
| 190 | Pressure-Side | 4.987 | 12.788 | 80 |
| 191 | Pressure-Side | 4.667 | 12.785 | 80 |
| 192 | Pressure-Side | 4.346 | 12.768 | 80 |
| 193 | Pressure-Side | 4.026 | 12.741 | 80 |
| 194 | Pressure-Side | 3.708 | 12.707 | 80 |
| 195 | Pressure-Side | 3.390 | 12.668 | 80 |
| 196 | Pressure-Side | 3.071 | 12.630 | 80 |
| 197 | Pressure-Side | 2.751 | 12.603 | 80 |
| 198 | Pressure-Side | 2.431 | 12.600 | 80 |
| 199 | Pressure-Side | 2.114 | 12.643 | 80 |
| 200 | Pressure-Side | 1.828 | 12.783 | 80 |
| 1 | Suction-Side | 1.637 | 14.574 | 90 |
| 2 | Suction-Side | 1.597 | 14.937 | 90 |
| 3 | Suction-Side | 1.666 | 15.296 | 90 |
| 4 | Suction-Side | 1.830 | 15.624 | 90 |
| 5 | Suction-Side | 2.063 | 15.906 | 90 |
| 6 | Suction-Side | 2.343 | 16.141 | 90 |
| 7 | Suction-Side | 2.654 | 16.336 | 90 |
| 8 | Suction-Side | 2.986 | 16.491 | 90 |
| 9 | Suction-Side | 3.332 | 16.612 | 90 |
| 10 | Suction-Side | 3.688 | 16.701 | 90 |
| 11 | Suction-Side | 4.049 | 16.762 | 90 |
| 12 | Suction-Side | 4.414 | 16.794 | 90 |
| 13 | Suction-Side | 4.781 | 16.802 | 90 |
| 14 | Suction-Side | 5.148 | 16.786 | 90 |
| 15 | Suction-Side | 5.512 | 16.747 | 90 |
| 16 | Suction-Side | 5.874 | 16.686 | 90 |
| 17 | Suction-Side | 6.231 | 16.605 | 90 |
| 18 | Suction-Side | 6.584 | 16.504 | 90 |
| 19 | Suction-Side | 6.930 | 16.386 | 90 |
| 20 | Suction-Side | 7.271 | 16.250 | 90 |
| 21 | Suction-Side | 7.605 | 16.097 | 90 |
| 22 | Suction-Side | 7.930 | 15.929 | 90 |
| 23 | Suction-Side | 8.249 | 15.747 | 90 |
| 24 | Suction-Side | 8.559 | 15.552 | 90 |
| 25 | Suction-Side | 8.861 | 15.344 | 90 |
| 26 | Suction-Side | 9.156 | 15.125 | 90 |
| 27 | Suction-Side | 9.442 | 14.896 | 90 |
| 28 | Suction-Side | 9.721 | 14.658 | 90 |
| 29 | Suction-Side | 9.992 | 14.411 | 90 |
| 30 | Suction-Side | 10.255 | 14.156 | 90 |
| 31 | Suction-Side | 10.512 | 13.894 | 90 |
| 32 | Suction-Side | 10.761 | 13.625 | 90 |
| 33 | Suction-Side | 11.004 | 13.350 | 90 |
| 34 | Suction-Side | 11.241 | 13.070 | 90 |
| 35 | Suction-Side | 11.472 | 12.785 | 90 |
| 36 | Suction-Side | 11.698 | 12.497 | 90 |
| 37 | Suction-Side | 11.918 | 12.203 | 90 |
| 38 | Suction-Side | 12.133 | 11.906 | 90 |
| 39 | Suction-Side | 12.343 | 11.606 | 90 |
| 40 | Suction-Side | 12.549 | 11.302 | 90 |
| 41 | Suction-Side | 12.750 | 10.996 | 90 |
| 42 | Suction-Side | 12.947 | 10.686 | 90 |
| 43 | Suction-Side | 13.141 | 10.375 | 90 |
| 44 | Suction-Side | 13.331 | 10.061 | 90 |
| 45 | Suction-Side | 13.518 | 9.746 | 90 |
| 46 | Suction-Side | 13.702 | 9.429 | 90 |
| 47 | Suction-Side | 13.884 | 9.110 | 90 |
| 48 | Suction-Side | 14.062 | 8.790 | 90 |
| 49 | Suction-Side | 14.237 | 8.468 | 90 |
| 50 | Suction-Side | 14.411 | 8.145 | 90 |
| 51 | Suction-Side | 14.582 | 7.820 | 90 |
| 52 | Suction-Side | 14.750 | 7.494 | 90 |
| 53 | Suction-Side | 14.917 | 7.168 | 90 |
| 54 | Suction-Side | 15.082 | 6.840 | 90 |
| 55 | Suction-Side | 15.245 | 6.512 | 90 |
| 56 | Suction-Side | 15.406 | 6.182 | 90 |
| 57 | Suction-Side | 15.566 | 5.852 | 90 |
| 58 | Suction-Side | 15.724 | 5.521 | 90 |
| 59 | Suction-Side | 15.881 | 5.190 | 90 |
| 60 | Suction-Side | 16.036 | 4.858 | 90 |
| 61 | Suction-Side | 16.190 | 4.525 | 90 |
| 62 | Suction-Side | 16.344 | 4.192 | 90 |
| 63 | Suction-Side | 16.496 | 3.858 | 90 |
| 64 | Suction-Side | 16.646 | 3.523 | 90 |
| 65 | Suction-Side | 16.796 | 3.189 | 90 |
| 66 | Suction-Side | 16.944 | 2.854 | 90 |
| 67 | Suction-Side | 17.092 | 2.518 | 90 |

TABLE 1-continued

| N | Location | X | Y | Z |
|---|---|---|---|---|
| 68 | Suction-Side | 17.240 | 2.182 | 90 |
| 69 | Suction-Side | 17.386 | 1.846 | 90 |
| 70 | Suction-Side | 17.531 | 1.509 | 90 |
| 71 | Suction-Side | 17.676 | 1.172 | 90 |
| 72 | Suction-Side | 17.820 | 0.835 | 90 |
| 73 | Suction-Side | 17.964 | 0.498 | 90 |
| 74 | Suction-Side | 18.107 | 0.160 | 90 |
| 75 | Suction-Side | 18.249 | −0.178 | 90 |
| 76 | Suction-Side | 18.391 | −0.516 | 90 |
| 77 | Suction-Side | 18.532 | −0.855 | 90 |
| 78 | Suction-Side | 18.673 | −1.193 | 90 |
| 79 | Suction-Side | 18.813 | −1.532 | 90 |
| 80 | Suction-Side | 18.953 | −1.871 | 90 |
| 81 | Suction-Side | 19.092 | −2.210 | 90 |
| 82 | Suction-Side | 19.232 | −2.550 | 90 |
| 83 | Suction-Side | 19.370 | −2.889 | 90 |
| 84 | Suction-Side | 19.509 | −3.229 | 90 |
| 85 | Suction-Side | 19.647 | −3.568 | 90 |
| 86 | Suction-Side | 19.784 | −3.909 | 90 |
| 87 | Suction-Side | 19.921 | −4.249 | 90 |
| 88 | Suction-Side | 20.059 | −4.588 | 90 |
| 89 | Suction-Side | 20.195 | −4.929 | 90 |
| 90 | Suction-Side | 20.332 | −5.270 | 90 |
| 91 | Suction-Side | 20.469 | −5.610 | 90 |
| 92 | Suction-Side | 20.605 | −5.950 | 90 |
| 93 | Suction-Side | 20.740 | −6.291 | 90 |
| 94 | Suction-Side | 20.876 | −6.632 | 90 |
| 95 | Suction-Side | 21.012 | −6.972 | 90 |
| 96 | Suction-Side | 21.147 | −7.313 | 90 |
| 97 | Suction-Side | 21.282 | −7.654 | 90 |
| 98 | Suction-Side | 21.418 | −7.995 | 90 |
| 99 | Suction-Side | 21.553 | −8.336 | 90 |
| 100 | Suction-Side | 21.560 | −8.694 | 90 |
| 101 | Pressure-Side | 21.317 | −8.958 | 90 |
| 102 | Pressure-Side | 21.003 | −8.993 | 90 |
| 103 | Pressure-Side | 20.734 | −8.824 | 90 |
| 104 | Pressure-Side | 20.570 | −8.546 | 90 |
| 105 | Pressure-Side | 20.412 | −8.264 | 90 |
| 106 | Pressure-Side | 20.255 | −7.982 | 90 |
| 107 | Pressure-Side | 20.098 | −7.700 | 90 |
| 108 | Pressure-Side | 19.940 | −7.418 | 90 |
| 109 | Pressure-Side | 19.783 | −7.136 | 90 |
| 110 | Pressure-Side | 19.625 | −6.853 | 90 |
| 111 | Pressure-Side | 19.469 | −6.571 | 90 |
| 112 | Pressure-Side | 19.312 | −6.289 | 90 |
| 113 | Pressure-Side | 19.155 | −6.007 | 90 |
| 114 | Pressure-Side | 18.998 | −5.724 | 90 |
| 115 | Pressure-Side | 18.842 | −5.442 | 90 |
| 116 | Pressure-Side | 18.686 | −5.158 | 90 |
| 117 | Pressure-Side | 18.530 | −4.876 | 90 |
| 118 | Pressure-Side | 18.374 | −4.593 | 90 |
| 119 | Pressure-Side | 18.218 | −4.310 | 90 |
| 120 | Pressure-Side | 18.062 | −4.027 | 90 |
| 121 | Pressure-Side | 17.907 | −3.744 | 90 |
| 122 | Pressure-Side | 17.751 | −3.461 | 90 |
| 123 | Pressure-Side | 17.596 | −3.177 | 90 |
| 124 | Pressure-Side | 17.441 | −2.894 | 90 |
| 125 | Pressure-Side | 17.286 | −2.611 | 90 |
| 126 | Pressure-Side | 17.131 | −2.327 | 90 |
| 127 | Pressure-Side | 16.977 | −2.044 | 90 |
| 128 | Pressure-Side | 16.822 | −1.760 | 90 |
| 129 | Pressure-Side | 16.667 | −1.477 | 90 |
| 130 | Pressure-Side | 16.512 | −1.193 | 90 |
| 131 | Pressure-Side | 16.358 | −0.909 | 90 |
| 132 | Pressure-Side | 16.204 | −0.626 | 90 |
| 133 | Pressure-Side | 16.050 | −0.342 | 90 |
| 134 | Pressure-Side | 15.896 | −0.058 | 90 |
| 135 | Pressure-Side | 15.742 | 0.226 | 90 |
| 136 | Pressure-Side | 15.588 | 0.510 | 90 |
| 137 | Pressure-Side | 15.433 | 0.794 | 90 |
| 138 | Pressure-Side | 15.279 | 1.078 | 90 |
| 139 | Pressure-Side | 15.125 | 1.362 | 90 |
| 140 | Pressure-Side | 14.971 | 1.646 | 90 |
| 141 | Pressure-Side | 14.817 | 1.930 | 90 |
| 142 | Pressure-Side | 14.663 | 2.213 | 90 |
| 143 | Pressure-Side | 14.509 | 2.497 | 90 |
| 144 | Pressure-Side | 14.355 | 2.781 | 90 |
| 145 | Pressure-Side | 14.200 | 3.065 | 90 |

TABLE 1-continued

| N | Location | X | Y | Z |
|---|---|---|---|---|
| 146 | Pressure-Side | 14.044 | 3.348 | 90 |
| 147 | Pressure-Side | 13.889 | 3.631 | 90 |
| 148 | Pressure-Side | 13.734 | 3.915 | 90 |
| 149 | Pressure-Side | 13.577 | 4.197 | 90 |
| 150 | Pressure-Side | 13.420 | 4.479 | 90 |
| 151 | Pressure-Side | 13.263 | 4.761 | 90 |
| 152 | Pressure-Side | 13.105 | 5.043 | 90 |
| 153 | Pressure-Side | 12.946 | 5.324 | 90 |
| 154 | Pressure-Side | 12.786 | 5.605 | 90 |
| 155 | Pressure-Side | 12.626 | 5.886 | 90 |
| 156 | Pressure-Side | 12.465 | 6.166 | 90 |
| 157 | Pressure-Side | 12.302 | 6.444 | 90 |
| 158 | Pressure-Side | 12.138 | 6.723 | 90 |
| 159 | Pressure-Side | 11.973 | 7.001 | 90 |
| 160 | Pressure-Side | 11.807 | 7.277 | 90 |
| 161 | Pressure-Side | 11.638 | 7.553 | 90 |
| 162 | Pressure-Side | 11.469 | 7.828 | 90 |
| 163 | Pressure-Side | 11.296 | 8.101 | 90 |
| 164 | Pressure-Side | 11.122 | 8.373 | 90 |
| 165 | Pressure-Side | 10.945 | 8.644 | 90 |
| 166 | Pressure-Side | 10.765 | 8.912 | 90 |
| 167 | Pressure-Side | 10.583 | 9.178 | 90 |
| 168 | Pressure-Side | 10.396 | 9.442 | 90 |
| 169 | Pressure-Side | 10.207 | 9.704 | 90 |
| 170 | Pressure-Side | 10.014 | 9.963 | 90 |
| 171 | Pressure-Side | 9.817 | 10.219 | 90 |
| 172 | Pressure-Side | 9.615 | 10.471 | 90 |
| 173 | Pressure-Side | 9.410 | 10.721 | 90 |
| 174 | Pressure-Side | 9.199 | 10.965 | 90 |
| 175 | Pressure-Side | 8.982 | 11.205 | 90 |
| 176 | Pressure-Side | 8.760 | 11.438 | 90 |
| 177 | Pressure-Side | 8.530 | 11.667 | 90 |
| 178 | Pressure-Side | 8.295 | 11.888 | 90 |
| 179 | Pressure-Side | 8.053 | 12.102 | 90 |
| 180 | Pressure-Side | 7.803 | 12.306 | 90 |
| 181 | Pressure-Side | 7.545 | 12.501 | 90 |
| 182 | Pressure-Side | 7.280 | 12.685 | 90 |
| 183 | Pressure-Side | 7.006 | 12.857 | 90 |
| 184 | Pressure-Side | 6.725 | 13.015 | 90 |
| 185 | Pressure-Side | 6.437 | 13.160 | 90 |
| 186 | Pressure-Side | 6.142 | 13.292 | 90 |
| 187 | Pressure-Side | 5.841 | 13.410 | 90 |
| 188 | Pressure-Side | 5.535 | 13.512 | 90 |
| 189 | Pressure-Side | 5.224 | 13.600 | 90 |
| 190 | Pressure-Side | 4.909 | 13.673 | 90 |
| 191 | Pressure-Side | 4.592 | 13.734 | 90 |
| 192 | Pressure-Side | 4.272 | 13.781 | 90 |
| 193 | Pressure-Side | 3.951 | 13.819 | 90 |
| 194 | Pressure-Side | 3.630 | 13.850 | 90 |
| 195 | Pressure-Side | 3.308 | 13.877 | 90 |
| 196 | Pressure-Side | 2.986 | 13.905 | 90 |
| 197 | Pressure-Side | 2.665 | 13.940 | 90 |
| 198 | Pressure-Side | 2.347 | 13.996 | 90 |
| 199 | Pressure-Side | 2.041 | 14.099 | 90 |
| 200 | Pressure-Side | 1.784 | 14.290 | 90 |
| 1 | Suction-Side | 1.597 | 16.131 | 100 |
| 2 | Suction-Side | 1.607 | 16.494 | 100 |
| 3 | Suction-Side | 1.725 | 16.836 | 100 |
| 4 | Suction-Side | 1.938 | 17.130 | 100 |
| 5 | Suction-Side | 2.217 | 17.364 | 100 |
| 6 | Suction-Side | 2.536 | 17.538 | 100 |
| 7 | Suction-Side | 2.879 | 17.660 | 100 |
| 8 | Suction-Side | 3.234 | 17.735 | 100 |
| 9 | Suction-Side | 3.597 | 17.771 | 100 |
| 10 | Suction-Side | 3.961 | 17.772 | 100 |
| 11 | Suction-Side | 4.323 | 17.741 | 100 |
| 12 | Suction-Side | 4.683 | 17.683 | 100 |
| 13 | Suction-Side | 5.037 | 17.599 | 100 |
| 14 | Suction-Side | 5.385 | 17.494 | 100 |
| 15 | Suction-Side | 5.727 | 17.368 | 100 |
| 16 | Suction-Side | 6.062 | 17.226 | 100 |
| 17 | Suction-Side | 6.389 | 17.067 | 100 |
| 18 | Suction-Side | 6.709 | 16.893 | 100 |
| 19 | Suction-Side | 7.022 | 16.705 | 100 |
| 20 | Suction-Side | 7.326 | 16.506 | 100 |
| 21 | Suction-Side | 7.622 | 16.295 | 100 |
| 22 | Suction-Side | 7.912 | 16.074 | 100 |
| 23 | Suction-Side | 8.194 | 15.844 | 100 |

TABLE 1-continued

| N | Location | X | Y | Z |
|---|---|---|---|---|
| 24 | Suction-Side | 8.470 | 15.606 | 100 |
| 25 | Suction-Side | 8.737 | 15.359 | 100 |
| 26 | Suction-Side | 8.998 | 15.105 | 100 |
| 27 | Suction-Side | 9.252 | 14.845 | 100 |
| 28 | Suction-Side | 9.500 | 14.578 | 100 |
| 29 | Suction-Side | 9.742 | 14.306 | 100 |
| 30 | Suction-Side | 9.978 | 14.028 | 100 |
| 31 | Suction-Side | 10.208 | 13.746 | 100 |
| 32 | Suction-Side | 10.433 | 13.460 | 100 |
| 33 | Suction-Side | 10.653 | 13.170 | 100 |
| 34 | Suction-Side | 10.868 | 12.876 | 100 |
| 35 | Suction-Side | 11.078 | 12.579 | 100 |
| 36 | Suction-Side | 11.284 | 12.279 | 100 |
| 37 | Suction-Side | 11.487 | 11.976 | 100 |
| 38 | Suction-Side | 11.684 | 11.670 | 100 |
| 39 | Suction-Side | 11.878 | 11.362 | 100 |
| 40 | Suction-Side | 12.069 | 11.052 | 100 |
| 41 | Suction-Side | 12.256 | 10.739 | 100 |
| 42 | Suction-Side | 12.440 | 10.425 | 100 |
| 43 | Suction-Side | 12.621 | 10.110 | 100 |
| 44 | Suction-Side | 12.799 | 9.792 | 100 |
| 45 | Suction-Side | 12.975 | 9.473 | 100 |
| 46 | Suction-Side | 13.148 | 9.153 | 100 |
| 47 | Suction-Side | 13.320 | 8.832 | 100 |
| 48 | Suction-Side | 13.489 | 8.510 | 100 |
| 49 | Suction-Side | 13.656 | 8.186 | 100 |
| 50 | Suction-Side | 13.821 | 7.861 | 100 |
| 51 | Suction-Side | 13.984 | 7.536 | 100 |
| 52 | Suction-Side | 14.146 | 7.210 | 100 |
| 53 | Suction-Side | 14.306 | 6.883 | 100 |
| 54 | Suction-Side | 14.464 | 6.555 | 100 |
| 55 | Suction-Side | 14.622 | 6.227 | 100 |
| 56 | Suction-Side | 14.778 | 5.898 | 100 |
| 57 | Suction-Side | 14.933 | 5.568 | 100 |
| 58 | Suction-Side | 15.087 | 5.239 | 100 |
| 59 | Suction-Side | 15.241 | 4.909 | 100 |
| 60 | Suction-Side | 15.393 | 4.578 | 100 |
| 61 | Suction-Side | 15.544 | 4.247 | 100 |
| 62 | Suction-Side | 15.695 | 3.915 | 100 |
| 63 | Suction-Side | 15.844 | 3.583 | 100 |
| 64 | Suction-Side | 15.993 | 3.251 | 100 |
| 65 | Suction-Side | 16.141 | 2.918 | 100 |
| 66 | Suction-Side | 16.289 | 2.586 | 100 |
| 67 | Suction-Side | 16.436 | 2.252 | 100 |
| 68 | Suction-Side | 16.582 | 1.919 | 100 |
| 69 | Suction-Side | 16.728 | 1.585 | 100 |
| 70 | Suction-Side | 16.873 | 1.252 | 100 |
| 71 | Suction-Side | 17.017 | 0.918 | 100 |
| 72 | Suction-Side | 17.162 | 0.583 | 100 |
| 73 | Suction-Side | 17.305 | 0.248 | 100 |
| 74 | Suction-Side | 17.449 | −0.086 | 100 |
| 75 | Suction-Side | 17.592 | −0.421 | 100 |
| 76 | Suction-Side | 17.735 | −0.756 | 100 |
| 77 | Suction-Side | 17.877 | −1.091 | 100 |
| 78 | Suction-Side | 18.019 | −1.427 | 100 |
| 79 | Suction-Side | 18.161 | −1.761 | 100 |
| 80 | Suction-Side | 18.303 | −2.097 | 100 |
| 81 | Suction-Side | 18.444 | −2.432 | 100 |
| 82 | Suction-Side | 18.585 | −2.768 | 100 |
| 83 | Suction-Side | 18.726 | −3.104 | 100 |
| 84 | Suction-Side | 18.867 | −3.440 | 100 |
| 85 | Suction-Side | 19.007 | −3.775 | 100 |
| 86 | Suction-Side | 19.147 | −4.112 | 100 |
| 87 | Suction-Side | 19.287 | −4.448 | 100 |
| 88 | Suction-Side | 19.427 | −4.784 | 100 |
| 89 | Suction-Side | 19.566 | −5.120 | 100 |
| 90 | Suction-Side | 19.706 | −5.456 | 100 |
| 91 | Suction-Side | 19.845 | −5.793 | 100 |
| 92 | Suction-Side | 19.984 | −6.129 | 100 |
| 93 | Suction-Side | 20.122 | −6.466 | 100 |
| 94 | Suction-Side | 20.261 | −6.803 | 100 |
| 95 | Suction-Side | 20.400 | −7.139 | 100 |
| 96 | Suction-Side | 20.538 | −7.476 | 100 |
| 97 | Suction-Side | 20.676 | −7.813 | 100 |
| 98 | Suction-Side | 20.813 | −8.150 | 100 |
| 99 | Suction-Side | 20.948 | −8.488 | 100 |
| 100 | Suction-Side | 20.937 | −8.845 | 100 |
| 101 | Pressure-Side | 20.695 | −9.106 | 100 |

TABLE 1-continued

| N | Location | X | Y | Z |
|---|---|---|---|---|
| 102 | Pressure-Side | 20.377 | −9.151 | 100 |
| 103 | Pressure-Side | 20.098 | −8.992 | 100 |
| 104 | Pressure-Side | 19.924 | −8.715 | 100 |
| 105 | Pressure-Side | 19.762 | −8.431 | 100 |
| 106 | Pressure-Side | 19.601 | −8.147 | 100 |
| 107 | Pressure-Side | 19.439 | −7.862 | 100 |
| 108 | Pressure-Side | 19.278 | −7.577 | 100 |
| 109 | Pressure-Side | 19.118 | −7.292 | 100 |
| 110 | Pressure-Side | 18.958 | −7.007 | 100 |
| 111 | Pressure-Side | 18.798 | −6.722 | 100 |
| 112 | Pressure-Side | 18.639 | −6.436 | 100 |
| 113 | Pressure-Side | 18.480 | −6.150 | 100 |
| 114 | Pressure-Side | 18.321 | −5.863 | 100 |
| 115 | Pressure-Side | 18.163 | −5.577 | 100 |
| 116 | Pressure-Side | 18.006 | −5.290 | 100 |
| 117 | Pressure-Side | 17.849 | −5.003 | 100 |
| 118 | Pressure-Side | 17.692 | −4.716 | 100 |
| 119 | Pressure-Side | 17.536 | −4.428 | 100 |
| 120 | Pressure-Side | 17.380 | −4.141 | 100 |
| 121 | Pressure-Side | 17.224 | −3.853 | 100 |
| 122 | Pressure-Side | 17.069 | −3.565 | 100 |
| 123 | Pressure-Side | 16.914 | −3.277 | 100 |
| 124 | Pressure-Side | 16.759 | −2.989 | 100 |
| 125 | Pressure-Side | 16.605 | −2.700 | 100 |
| 126 | Pressure-Side | 16.451 | −2.412 | 100 |
| 127 | Pressure-Side | 16.297 | −2.123 | 100 |
| 128 | Pressure-Side | 16.144 | −1.834 | 100 |
| 129 | Pressure-Side | 15.991 | −1.544 | 100 |
| 130 | Pressure-Side | 15.839 | −1.255 | 100 |
| 131 | Pressure-Side | 15.686 | −0.966 | 100 |
| 132 | Pressure-Side | 15.534 | −0.676 | 100 |
| 133 | Pressure-Side | 15.382 | −0.386 | 100 |
| 134 | Pressure-Side | 15.231 | −0.096 | 100 |
| 135 | Pressure-Side | 15.079 | 0.194 | 100 |
| 136 | Pressure-Side | 14.928 | 0.484 | 100 |
| 137 | Pressure-Side | 14.777 | 0.774 | 100 |
| 138 | Pressure-Side | 14.626 | 1.064 | 100 |
| 139 | Pressure-Side | 14.475 | 1.354 | 100 |
| 140 | Pressure-Side | 14.324 | 1.645 | 100 |
| 141 | Pressure-Side | 14.174 | 1.936 | 100 |
| 142 | Pressure-Side | 14.023 | 2.226 | 100 |
| 143 | Pressure-Side | 13.873 | 2.516 | 100 |
| 144 | Pressure-Side | 13.722 | 2.807 | 100 |
| 145 | Pressure-Side | 13.572 | 3.097 | 100 |
| 146 | Pressure-Side | 13.420 | 3.387 | 100 |
| 147 | Pressure-Side | 13.269 | 3.678 | 100 |
| 148 | Pressure-Side | 13.118 | 3.967 | 100 |
| 149 | Pressure-Side | 12.965 | 4.257 | 100 |
| 150 | Pressure-Side | 12.813 | 4.546 | 100 |
| 151 | Pressure-Side | 12.660 | 4.836 | 100 |
| 152 | Pressure-Side | 12.507 | 5.124 | 100 |
| 153 | Pressure-Side | 12.353 | 5.413 | 100 |
| 154 | Pressure-Side | 12.197 | 5.701 | 100 |
| 155 | Pressure-Side | 12.042 | 5.989 | 100 |
| 156 | Pressure-Side | 11.885 | 6.275 | 100 |
| 157 | Pressure-Side | 11.726 | 6.562 | 100 |
| 158 | Pressure-Side | 11.567 | 6.847 | 100 |
| 159 | Pressure-Side | 11.406 | 7.132 | 100 |
| 160 | Pressure-Side | 11.242 | 7.416 | 100 |
| 161 | Pressure-Side | 11.077 | 7.699 | 100 |
| 162 | Pressure-Side | 10.911 | 7.980 | 100 |
| 163 | Pressure-Side | 10.741 | 8.260 | 100 |
| 164 | Pressure-Side | 10.570 | 8.539 | 100 |
| 165 | Pressure-Side | 10.396 | 8.815 | 100 |
| 166 | Pressure-Side | 10.219 | 9.090 | 100 |
| 167 | Pressure-Side | 10.039 | 9.364 | 100 |
| 168 | Pressure-Side | 9.856 | 9.635 | 100 |
| 169 | Pressure-Side | 9.669 | 9.903 | 100 |
| 170 | Pressure-Side | 9.479 | 10.169 | 100 |
| 171 | Pressure-Side | 9.285 | 10.433 | 100 |
| 172 | Pressure-Side | 9.086 | 10.693 | 100 |
| 173 | Pressure-Side | 8.883 | 10.950 | 100 |
| 174 | Pressure-Side | 8.676 | 11.203 | 100 |
| 175 | Pressure-Side | 8.464 | 11.452 | 100 |
| 176 | Pressure-Side | 8.247 | 11.696 | 100 |
| 177 | Pressure-Side | 8.023 | 11.935 | 100 |
| 178 | Pressure-Side | 7.795 | 12.170 | 100 |
| 179 | Pressure-Side | 7.561 | 12.399 | 100 |

TABLE 1-continued

| N | Location | X | Y | Z |
|---|---|---|---|---|
| 180 | Pressure-Side | 7.322 | 12.621 | 100 |
| 181 | Pressure-Side | 7.076 | 12.838 | 100 |
| 182 | Pressure-Side | 6.825 | 13.047 | 100 |
| 183 | Pressure-Side | 6.568 | 13.249 | 100 |
| 184 | Pressure-Side | 6.305 | 13.444 | 100 |
| 185 | Pressure-Side | 6.036 | 13.631 | 100 |
| 186 | Pressure-Side | 5.762 | 13.809 | 100 |
| 187 | Pressure-Side | 5.483 | 13.979 | 100 |
| 188 | Pressure-Side | 5.199 | 14.141 | 100 |
| 189 | Pressure-Side | 4.909 | 14.293 | 100 |
| 190 | Pressure-Side | 4.615 | 14.436 | 100 |
| 191 | Pressure-Side | 4.316 | 14.571 | 100 |
| 192 | Pressure-Side | 4.014 | 14.696 | 100 |
| 193 | Pressure-Side | 3.709 | 14.814 | 100 |
| 194 | Pressure-Side | 3.402 | 14.926 | 100 |
| 195 | Pressure-Side | 3.094 | 15.036 | 100 |
| 196 | Pressure-Side | 2.785 | 15.145 | 100 |
| 197 | Pressure-Side | 2.479 | 15.262 | 100 |
| 198 | Pressure-Side | 2.182 | 15.397 | 100 |
| 199 | Pressure-Side | 1.907 | 15.573 | 100 |
| 200 | Pressure-Side | 1.697 | 15.821 | 100 |

It will also be appreciated that the airfoil disclosed in the above Table 1 may be scaled up or down geometrically for use in other similar turbine designs. Consequently, the coordinate values set forth in Table 1 may be scaled upwardly or downwardly such that the airfoil profile shape remains unchanged. A scaled version of the coordinates in Table 1 would be represented by X, Y and Z coordinate values of Table 1, with X and Y and the non-dimensional Z coordinate value converted to inches, multiplied or divided by a constant number.

An important term in this disclosure is profile. The profile is the range of the variation between measured points on an airfoil surface and the ideal position listed in Table 1. The actual profile on a manufactured blade will be different than those in Table 1 and the design is robust to this variation meaning that mechanical and aerodynamic function are not impaired. As noted above, a + or −5% profile tolerance is used herein. The X, Y and Z values are all non-dimensionalized relative to the airfoil height.

The disclosed airfoil shape optimizes and is specific to the machine conditions and specifications. It provides a unique profile to achieve 1) interaction between other stages in the high pressure turbine; 2) aerodynamic efficiency; and 3) normalized aerodynamic and mechanical blade loadings. The disclosed loci of points allow the gas turbine or any other suitable turbine to run in an efficient, safe and smooth manner. As also noted, any scale of the disclosed airfoil may be adopted as long as 1) interaction between other stages in the high pressure turbine; 2) aerodynamic efficiency; and 3) normalized aerodynamic and mechanical blade loadings are maintained in the scaled turbine.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A turbine bucket including a bucket airfoil having an airfoil shape, the bucket airfoil having a nominal profile substantially in accordance with Cartesian coordinate values of X, Y and Z set forth in Table 1 wherein the Z values are non-dimensional values from 0% to 100% convertible to Z distances in inches by multiplying the Z values by a height of the airfoil in inches and adding the radius of the airfoil base, and wherein X and Y are distances in inches which, when connected by smooth continuing arcs, define airfoil profile sections at each distance Z, the profile sections at the Z distances being joined smoothly with one another to form a complete airfoil shape.

2. The turbine bucket according to claim 1, forming part of a stage of a turbine.

3. The turbine bucket according to claim 1, wherein the airfoil shape lies in an envelope within +/−5% in a direction normal to any airfoil surface location.

4. The turbine bucket according to claim 1, wherein a height of the turbine bucket is about 10 inches to about 40 inches.

5. A turbine bucket including a bucket airfoil having a suction-side uncoated nominal airfoil profile substantially in accordance with suction-side Cartesian coordinate values of X, Y and Z set forth in Table 1 wherein the Z values are non-dimensional values from 0% to 100% convertible to Z distances in inches by multiplying the Z values by a height of the airfoil in inches and adding the radius of the airfoil base, and wherein X and Y are distances in inches which, when connected by smooth continuing arcs, define airfoil profile sections at each Z distance, the profile sections at the Z distances being joined smoothly with one another to form a complete suction-side airfoil shape, the X, Y and Z distances being scalable as a function of the same constant or number to provide a scaled-up or scaled-down airfoil.

6. The turbine bucket according to claim 5, forming part of a stage of a turbine.

7. The turbine bucket according to claim 5, wherein the suction-side airfoil shape lies in an envelope within +/−5% in a direction normal to any suction-side airfoil surface location.

8. The turbine bucket according to claim 5, wherein a height of the turbine bucket is about 10 inches to about 40 inches.

9. A turbine comprising a turbine wheel having a plurality of buckets, each of the buckets including an airfoil having an airfoil shape, the airfoil having a nominal profile substantially in accordance with Cartesian coordinate values of X, Y and Z set forth in Table 1 wherein the Z values are non-dimensional values from 0% to 100% convertible to Z distances in inches by multiplying the Z values by a height of the airfoil in inches and adding the radius of the airfoil base, and wherein X and Y are distances in inches which, when connected by smooth continuing arcs, define the airfoil profile sections at each distance Z, the profile sections at the Z distances being joined smoothly with one another to form a complete airfoil shape.

10. The turbine according to claim 9, wherein the turbine wheel comprises a stage of the turbine.

11. The turbine according to claim 9, wherein X represents a distance parallel to the turbine axis of rotation.

12. The turbine according to claim 9, wherein the airfoil shape lies in an envelope within +/−5% in a direction normal to any airfoil surface location.

13. A turbine according to claim 9, wherein a height of the turbine bucket is about 10 inches to about 40 inches.

14. A turbine comprising a turbine wheel having a plurality of buckets, each of the buckets including an airfoil having a suction-side airfoil shape, the airfoil having a nominal profile substantially in accordance with suction-side Cartesian coordinate values of X, Y and Z set forth in Table 1 wherein the Z values are non-dimensional values from 0% to 100% convertible to Z distances in inches by multiplying the Z values by a height of the airfoil in inches and adding the radius of the airfoil base, and wherein X and Y are distances in inches which, when connected by smooth continuing arcs, define the airfoil profile sections at each distance Z, the profile sections at the Z distances being joined smoothly with one another to form a complete suction-side airfoil shape.

15. The turbine according to claim 14, wherein the turbine wheel comprises a stage of the turbine.

16. The turbine according to claim 14, wherein X represents a distance parallel to the turbine axis of rotation.

17. The turbine according to claim 14, wherein the suction-side airfoil shape lies in an envelope within +/−5% in a direction normal to any suction-side airfoil surface location.

18. The turbine according to claim 14, wherein a height of the turbine bucket is about 10 inches to about 40 inches.

* * * * *